US010513873B2

(12) United States Patent
Tomaszewski et al.

(10) Patent No.: US 10,513,873 B2
(45) Date of Patent: Dec. 24, 2019

(54) CLOSURE LATCH FOR VEHICLE DOOR

(71) Applicant: Magna Closures Inc., Newmarket (CA)

(72) Inventors: Kris Tomaszewski, Newmarket (CA); Alex Kaczmarczyk, Newmarket (CA)

( * ) Notice: Subject to any disclaimer, the term of this patent is extended or adjusted under 35 U.S.C. 154(b) by 1115 days.

(21) Appl. No.: 14/721,036

(22) Filed: May 26, 2015

(65) Prior Publication Data

US 2016/0017645 A1 Jan. 21, 2016

Related U.S. Application Data

(63) Continuation of application No. PCT/CA2013/050907, filed on Nov. 26, 2013.
(Continued)

(30) Foreign Application Priority Data

Nov. 26, 2013 (WO) ..... PCT/CA2013/050907

(51) Int. Cl.
*E05B 85/00* (2014.01)
*E05B 77/26* (2014.01)
(Continued)

(52) U.S. Cl.
CPC ..... *E05B 85/01* (2013.01); *E05B 77/26* (2013.01); *E05B 77/265* (2013.01); *E05B 77/32* (2013.01);
(Continued)

(58) Field of Classification Search
CPC ..... E05B 77/26; E05B 77/30; E05B 81/06; E05B 81/16; E05B 81/42; E05B 81/64;
(Continued)

(56) References Cited

U.S. PATENT DOCUMENTS 4,929,007 A * 5/1990 Bartczak ..... E05B 83/36 292/216
5,092,638 A * 3/1992 Mizuki ..... E05B 77/265 292/216
(Continued)

FOREIGN PATENT DOCUMENTS

CA 2697768 A1 9/2010

OTHER PUBLICATIONS

Written Opinion (corrected) dated Feb. 11, 2014 issued from the Canadian Intellectual Property Office relating to PCT International Application No. PCT/CA2013/050907.
(Continued)

*Primary Examiner* — Christine M Mills

(57) ABSTRACT

In an embodiment, a latch includes a ratchet and pawl. A lock includes a link pivotable between unlocked and locked positions wherein a release lever operates the pawl, and the lever disconnects from the pawl respectively. A cam rotates between unlocking and locking positions wherein the link can move to the unlocked position, and the link pivots to the locked position respectively. An override member rotates between actuatable and non-actuatable positions wherein the lever can engage the override member to unlock the cam, and the lever disconnects from the override member respectively. The lock is positionable in an unlocked state wherein the link is unlocked, a locked state wherein the link is locked, the cam is in the locking position and the override member is actuatable, and a second locked state wherein the link is locked, the cam is in the locking position and the override member is non-actuatable.

11 Claims, 16 Drawing Sheets

Related U.S. Application Data

(60) Provisional application No. 61/730,362, filed on Nov. 27, 2012.

(51) Int. Cl.

| | |
|---|---|
| ***E05B 81/06*** | (2014.01) |
| ***E05B 81/14*** | (2014.01) |
| ***E05B 81/16*** | (2014.01) |
| ***E05B 81/34*** | (2014.01) |
| ***E05B 81/78*** | (2014.01) |
| ***E05B 81/90*** | (2014.01) |
| ***E05B 77/32*** | (2014.01) |
| ***E05B 81/42*** | (2014.01) |
| ***E05B 81/72*** | (2014.01) |

(52) U.S. Cl.
CPC ..... *E05B 81/06* (2013.01); *E05B 81/14* (2013.01); *E05B 81/16* (2013.01); *E05B 81/34* (2013.01); *E05B 81/42* (2013.01); *E05B 81/72* (2013.01); *E05B 81/78* (2013.01); *E05B 81/90* (2013.01)

(58) Field of Classification Search
CPC ..... E05B 81/72; E05B 81/74; E05B 85/01; E05B 77/32; E05B 81/90; E05B 81/34; E05B 81/14; E05B 77/265; E05B 81/78; Y10S 292/23; Y10T 292/1047; Y10T 292/1082
USPC ..... 292/216, 201, DIG. 23
See application file for complete search history.

(56) References Cited

U.S. PATENT DOCUMENTS

| | | | | |
|---|---|---|---|---|
| 6,102,453 | A * | 8/2000 | Cetnar | E05B 77/28 292/199 |
| 6,168,215 | B1 * | 1/2001 | Kodama | E05B 81/06 292/201 |
| 6,526,790 | B2 * | 3/2003 | Wegner | E05B 81/06 292/201 |
| 6,764,113 | B1 * | 7/2004 | Cetnar | E05B 81/06 292/201 |
| 7,380,845 | B2 * | 6/2008 | Suzumura | E05B 77/26 292/216 |
| 7,552,952 | B2 * | 6/2009 | Roesslinger | E05B 81/66 292/201 |
| 7,926,857 | B2 * | 4/2011 | Akizuki | E05B 77/26 292/201 |
| 8,141,916 | B2 * | 3/2012 | Tomaszewski | E05B 77/26 292/201 |
| 8,146,965 | B2 * | 4/2012 | Akizuki | E05B 81/06 292/201 |
| 2003/0006618 | A1 * | 1/2003 | Kalsi | E05B 81/06 292/201 |
| 2006/0131893 | A1 * | 6/2006 | Tomaszewski | E05B 81/06 292/216 |
| 2008/0203737 | A1 * | 8/2008 | Tomaszewski | E05B 77/26 292/216 |
| 2009/0241617 | A1 * | 10/2009 | Takahashi | E05B 81/16 70/257 |
| 2010/0244466 | A1 * | 9/2010 | Tomaszewski | E05B 77/26 292/201 |
| 2011/0259061 | A1 * | 10/2011 | Brose | E05B 81/06 70/237 |
| 2015/0284977 | A1 * | 10/2015 | Barmscheidt | E05B 81/14 292/200 |

OTHER PUBLICATIONS

International Search Report (corrected) dated Feb. 11, 2014 issued from the Canadian Intellectual Property Office relating to PCT International Application No. PCT/CA2013/050907.

* cited by examiner

CLOSURE LATCH FOR VEHICLE DOOR

CROSS-REFERENCE TO RELATED APPLICATIONS

This application is a continuation application of PCT International Application No. PCT/CA2013/050907 filed Nov. 26, 2013 which claims priority from U.S. Provisional Patent Application No. 61/730,362 filed Nov. 27, 2012, the contents of which are incorporated herein in their entirety.

FIELD

The present disclosure relates to a closure latch for a vehicle door, and more particularly to a closure latch for a vehicle door equipped with a passive entry feature.

BACKGROUND

Passive entry systems for vehicles are provided on some vehicles to permit a vehicle user who is in possession of the vehicle key to simply pull the door handle and open the door without the need to introduce the key into a keyhole in the door. The key fob is typically equipped with an electronic device that communicates with the vehicle's on-board control system to authenticate the user. When the user pulls the door handle to indicate that he/she wishes entry into the vehicle, he/she pulls the outside door handle and an electric actuator releases the ratchet to open the door. The outside handle is equipped with a switch that triggers the electric actuator. The latch may also be openable mechanically from inside the vehicle since the inside handle is connected to the inside door release lever on the latch. In some jurisdictions, however, there are regulations that govern the degree of connection between the inside door handle and the ratchet from the closure latch (particularly for a rear door, where children may be the occupants). In one aspect, it would be advantageous to provide a closure latch that can be used on a rear door of a vehicle, and that provides electrical release from outside the vehicle (e.g. for passive entry) and that provides mechanical release from inside the vehicle.

SUMMARY

In a first aspect, the disclosure is directed to a closure latch for a vehicle door. The closure latch has a ratchet and a lock that has a double pull override feature, wherein, when the lock is in a locked state, the inside door release lever can be actuated once to unlock the lock and a second time to open the vehicle door.

In a particular embodiment, the closure latch includes a ratchet movable between an open position and a closed position and biased towards the open position. A pawl is provided and is movable between a ratchet locking position wherein the pawl holds the ratchet in the closed position and a ratchet release position wherein the pawl permits the ratchet to move to the open position, and wherein the pawl is biased towards the ratchet locking position. An inside door release lever is operatively connectable to the pawl. A lock includes a lock link pivotable between an unlocked position wherein the lock link operatively connects the inside door release lever to the pawl, and a locked position wherein the inside door release lever operatively disconnects the inside door release lever from the pawl, wherein the lock link is biased towards the unlocked position. The lock further includes a first cam rotatable between an unlocking position wherein the first cam permits the lock link to pivot to the unlocked position, and a locking position wherein the first cam directly pivots the lock link to the locked position. The lock further includes an override member connected for rotation with the first cam and rotatable between an actuatable position wherein the inside door release lever is engageable with the override member to move the first cam to the unlocking position, and a non-actuatable position wherein the inside door release lever is operatively disconnected from the override member. The lock is positionable in an unlocked state wherein the lock link is in the unlocked position, a locked state wherein the lock link is in the locked position, the first cam is in the locking position and the override member is in the actuatable position, and a second locked state wherein the lock link is in the locked position, the first cam is in the locking position and the override member is in the non-actuatable position.

In yet another aspect, the disclosure is directed to a closure latch for a vehicle door, that provides electric actuation to open the ratchet, and that provides a lock with at least two lock states including a first lock state wherein the lock is unlocked and at least a second lock state selected from the group consisting of: a locked state with a double pull override feature; a child-locked state; and a double-locked state. In some embodiments, the latch can have all of these states.

In yet another aspect, the disclosure is directed to a closure latch with a power release actuator for releasing the pawl and the ratchet thereby opening the latch and the vehicle door. Optionally the outside door handle is operatively connected to the pawl through the power release actuator by way of an outside door release state switch that sends signals to an ECU that controls the operation of the power release actuator. Optionally the inside door handle is mechanically operatively connected to the pawl, and may additionally be operatively connected to the pawl through the power release actuator by way of an inside door handle state switch that also sends signals to the ECU.

BRIEF DESCRIPTION OF THE DRAWINGS

The present disclosure will now be described by way of example only with reference to the attached drawings, in which.

DETAILED DESCRIPTION

It will be noted that any reference in this disclosure to movement up, down, to the left, to the right, clockwise or counter-clockwise is in relation to the view shown in a particular figure or set of figures only.

Figure 11:
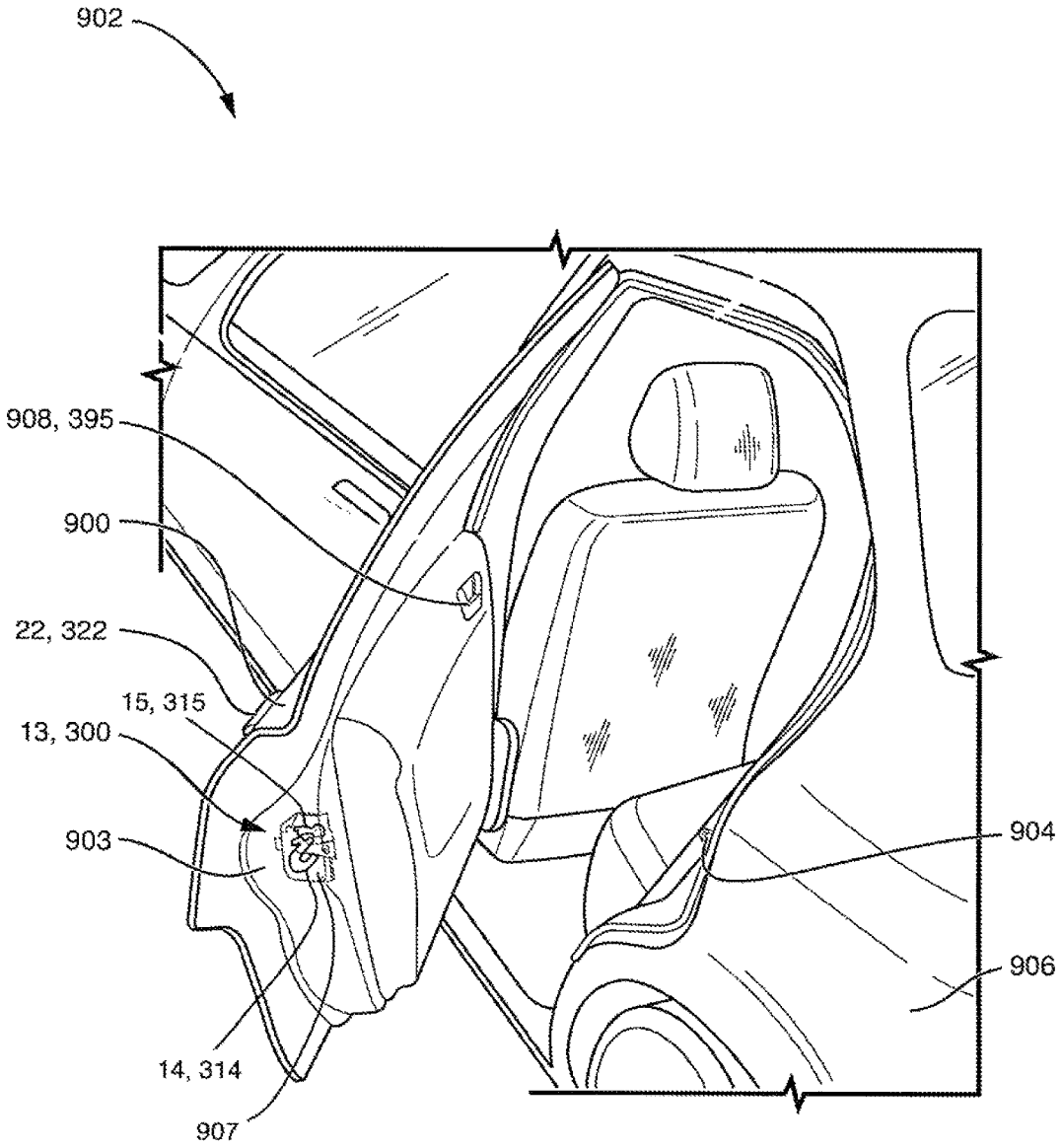
FIG. 11 is a perspective view of a vehicle with a door that includes the closure latch shown in FIG. 1.

Reference is made to FIG. 11, which shows an embodiment of a closure latch 13 for a vehicle door 900 of a vehicle 902. The closure latch 13 may be positioned on a rear edge face 903 of the vehicle door 900 and arranged in a suitable orientation to engage a striker 904 on the vehicle body shown at 906 when the door 902 is closed.

Figure 1:
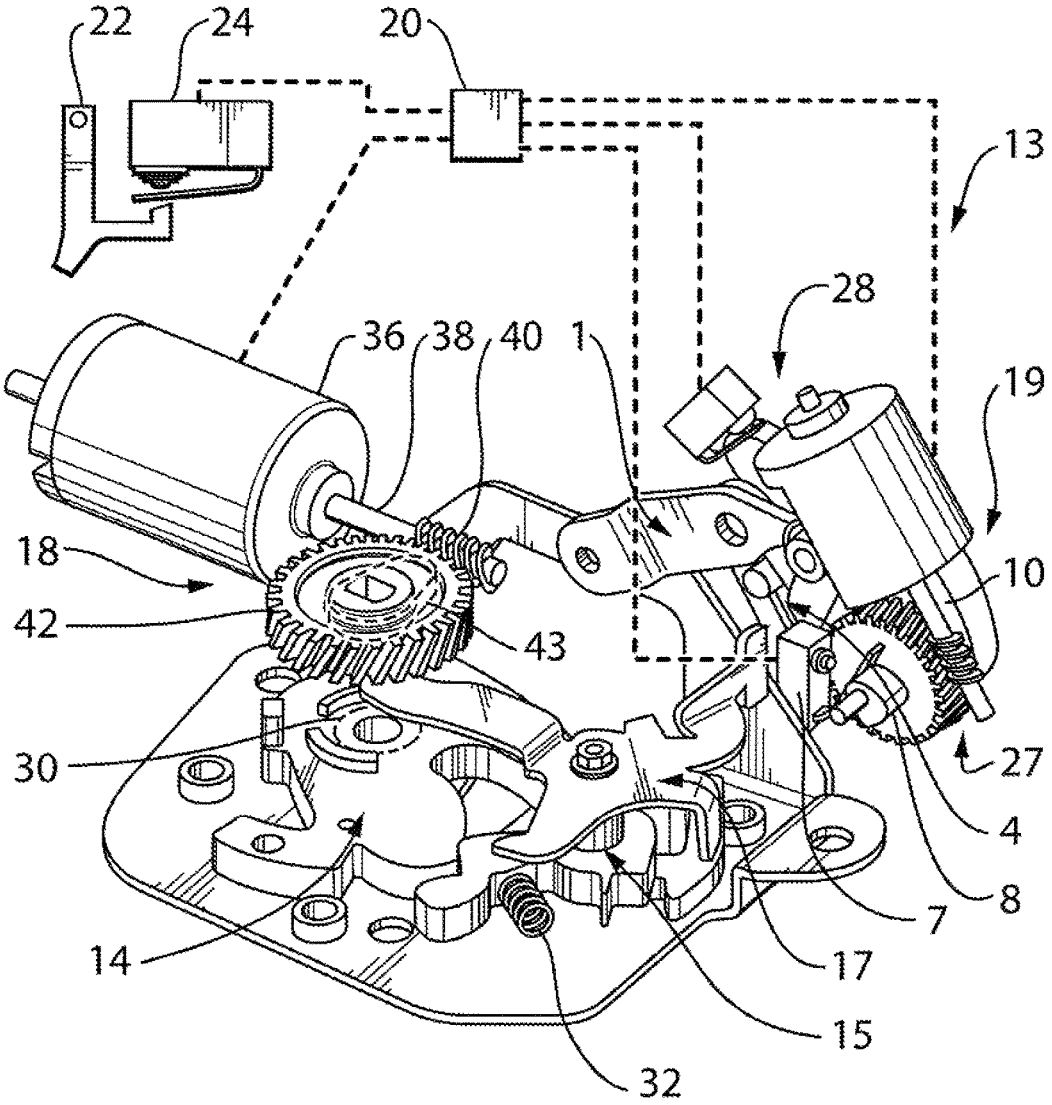
FIG. 1 is an elevation view of an embodiment of a closure latch.

Referring to FIG. 1, the closure latch 13 includes a ratchet 14, a pawl 15, a pawl release lever 17, an inside door release lever 1, a power release actuator 18 and a lock 27, which includes a lock mechanism 28 and a lock actuator 19. The ratchet 14 is movable between a closed position (FIG. 1) wherein the ratchet 14 retains the striker 904 (FIG. 11), and an open position (FIG. 11) wherein the ratchet 14 permits release of the striker 904. In FIG. 11, a cover plate 907 that covers components of the closure latch 13 is shown as being transparent so as not to obscure the ratchet 14 and pawl 15. Referring to FIG. 1, a ratchet biasing member 30, such as a torsion spring, may be provided to bias the ratchet 14 towards the open position.

The pawl 15 is movable between a ratchet locking position (FIG. 1) wherein the pawl 15 holds the ratchet 14 in the closed position, and a ratchet release position (FIG. 11) wherein the pawl 15 permits the ratchet 14 to be in the open position. A pawl biasing member 32, such as a suitable spring, may be provided to bias the pawl 15 towards the ratchet locking position.

The pawl release lever 17 is operatively connected to the pawl 15 and is movable between a pawl release position wherein the pawl release lever 17 moves the pawl 15 to the ratchet release position, and a home position (FIG. 1) wherein the pawl release lever 17 permits the pawl 15 to be in the ratchet locking position.

A release lever biasing member 34, such as a suitable spring, may be provided to bias the pawl release lever 17 to the home position.

The pawl release lever 17 may be moved to the pawl release position by several components, such as, for example, by the power release actuator 18, by the inside door release lever 1.

The power release actuator 18 includes a power release actuator motor 36 having a power release actuator motor output shaft 38, a power release worm gear 40 mounted on the output shaft 38, and a power release driven gear 42. A power release cam 43 is connected for rotation with the driven gear 42 and is rotatable between a pawl release range of positions and a pawl non-release range of positions. In FIG. 1, the power release cam 43 is a position that is within the pawl non-release range. The driven gear 42 is driven by the worm gear 40 and in turn drives the cam 43 which drives the pivoting of the pawl release lever 17 between the home and pawl release positions.

The power release actuator 18 may be used as part of a passive entry feature. When a person approaches the vehicle with an electronic key fob and opens the outside door handle 22, the vehicle senses both the presence of the key fob and that the door handle has been actuated (e.g. via communication between a switch 24 and an electronic control unit (ECU) shown at 20 that at least partially controls the operation of the closure latch 13). In turn, the ECU 20 actuates the power release actuator 18 to open the closure latch 13, so as to open the vehicle door.

Figure 2A:
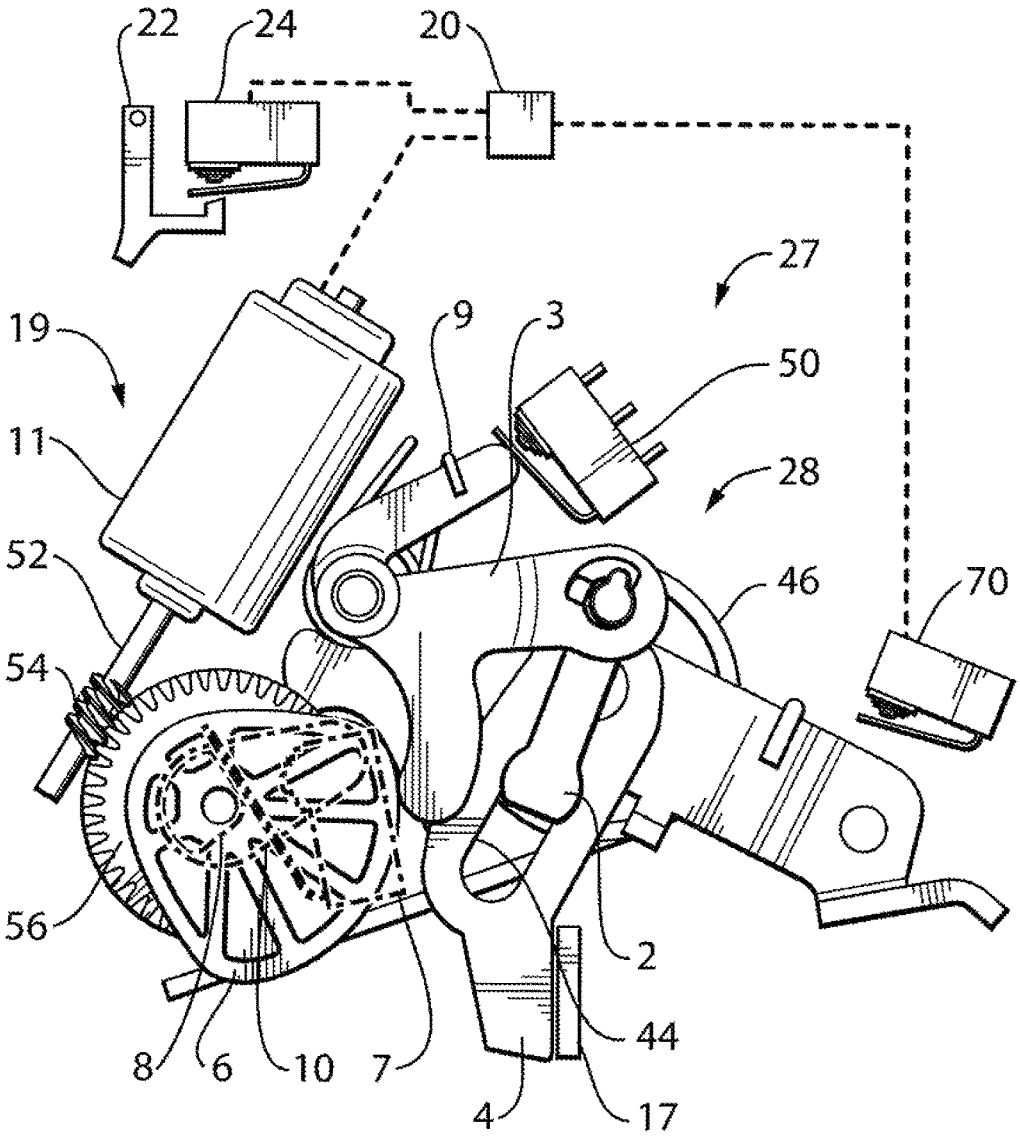
FIG. 2*a* is a plan view of a lock that is part of the closure latch shown in FIG. 1, in a locked state.

The lock 27 controls the operative connection between the inside door release lever 1 and the pawl release lever 17. Referring to FIG. 2*a*, the lock mechanism 28 includes an auxiliary release lever 4, a lock link 2 and a lock lever 3. The auxiliary release lever 4 is operatively connected to the pawl release lever 17, and is movable between a home position (shown in FIG. 2*a*) wherein the auxiliary release lever 4 permits the pawl release lever 17 to be in the home position, and a pawl release position wherein the auxiliary release lever 4 moves the pawl release lever 17 to the pawl release position.

The lock link 2 is slidable within a slot 44 in the auxiliary release lever 4 and controls the connection between the inside door release lever 1 and the auxiliary release lever 4. The lock link 2 is movable between a locked position (FIG. 2*a*) and an unlocked position (FIG. 2*c*). When the lock link 2 is in the unlocked position, the lock link 2 is positioned in the path of the inside door release lever 1 from a home position (FIG. 2*a*) to an actuated position (not shown). As a result, when the inside door release lever 1 is moved from the home position to the actuated position, the inside door release lever 1 engages and moves the lock link 2 and as a result the movement causes the auxiliary release lever 4 to rotate from the home position to the pawl release position (FIG. 11). When the lock link 2 is in the locked position (FIG. 2*a*), the lock link 2 is not in the path of the inside door release lever 1. As a result, movement of the inside door release lever 1 from the home position to the actuated position does not result in any corresponding movement of the auxiliary release lever 4 away from the home position.

The lock lever 3 is operatively connected to the lock link 2 and is movable between a locked position (FIG. 2*a*) wherein the lock lever 3 positions the lock link 2 in the locked position, and an unlocked position (FIG. 2*c*) wherein the lock lever 3 positions the lock link 2 in the unlocked position.

An inside door release lever biasing member 46, such as a suitable spring, may be provided to bias the inside door release lever 1 to the home position. A lock lever biasing member 9, such as a suitable spring, may be provided to bias the lock lever 3 to the unlocked position.

The lock actuator 19 controls the position and operation of the lock mechanism 28. The lock actuator 19 includes a lock actuator motor 11 which has a lock actuator motor output shaft 52 with a lock actuator worm gear 54 thereon, a lock actuator driven gear 56, a lock lever cam 6, an override member 10, a lock lever cam state switch cam 8 and a lock lever cam state switch 7. The lock lever cam 6, the inside door release lever cam 10 and the lock lever cam state switch cam 8 are all fixed together and rotatable with the driven gear 56. The override member 10, the switch cam 8 and the switch 7 are shown in dashed outline in FIGS. 2*a*-2*d* as a result of being obstructed from view by lock lever cam 6. The cam 8 and switch 7 are shown in FIG. 1, however.

The lock lever cam 6 is operatively connected to the lock lever 3, and is rotatable between a locking range of positions and an unlocking range of positions. When in a position that is within the locking range of positions (examples of which are shown in FIGS. 2*a* and 2*d*), the lock lever cam 6 holds the lock lever 3 in the locked position. When in a position that is within the unlocking range of positions (an example of which is shown in FIG. 2*c*), the lock lever cam 6 permits the lock lever 3 to move to the unlocked position.

The lock lever cam state switch cam 8 is movable between an unlocking range of positions (an example of which is shown in FIG. 2*c*), and a locking range of positions (an example of which is shown in FIG. 2*a*). Movement of the lock lever cam state switch cam 8 between the unlocking and locking ranges changes the state of the lock lever cam state switch 7. For example, the switch 7 may be open when the lock lever cam state switch cam 8 is in the locking range and may be closed when the lock lever cam state switch cam 8 is in the unlocking range, or vice versa. The state of the lock lever cam state switch 7 may be used by the ECU 20 to determine whether or not to permit the outside door handle 22 to be operatively connected to the pawl release lever 17 (via the power release actuator 18 shown in FIG. 1). It will be noted that it is alternatively possible for the operation of the switch 7 to be reversed and for the profile of the lock lever cam state switch cam 8 to be reversed, such that opening of the switch 7 would indicate to the ECU 20 that the lock 27 was unlocked, and closing of the switch 7 would indicate to the ECU 20 that the lock 27 was locked.

A lock lever state switch 50 can be used to indicate to the ECU 20, the state of the lock lever 3 (i.e. whether the lock lever 3 is in the locked or unlocked position). It will be understood that the lock lever state switch 50 is an alternative switch that can be provided instead of the switch 7 and switch cam 8. In other words, if the switch 50 is provided, the switch 7 and cam 8 may be omitted. Alternatively if the switch 7 and cam 8 are provided, the switch 50 may be omitted.

The override member 10 is movable between an actuatable range of positions (an example of which is shown in FIG. 2*a*), and a non-actuatable range of positions (examples of which are shown in FIGS. 2*c* and 2*d*). The operation of the override member 10 is described further below.

Rotation of the lock actuator motor 11 drives the rotation of the driven gear 56 (through the worm gear 54) and therefore drives the movement of the lock lever cam 6, the lock lever cam state switch cam 8 and the inside door release lever cam 10.

For a rear door application, the lock 27 may have three lock states: locked (FIG. 2*a*), unlocked (FIG. 2*c*), and child-locked (FIG. 2*d*).

Referring to FIG. 2*c*, when the lock 27 is in the unlocked state, the lock lever cam 6 is within the unlocking range and as a result, the lock lever 3 and lock link 2 are in their unlocked positions. As a result, the inside door release lever 1 is operatively connected to the pawl release lever 17 (and therefore to the pawl 15 shown in FIG. 1) through the lock link 2 and the auxiliary release lever 4. Thus, actuation of the inside door release lever 1 to the actuated position results in the actuation of pawl release lever 17 and thus movement of the pawl 15 to the ratchet release position (FIG. 11), thereby releasing the ratchet 14. Additionally, referring to FIG. 2*c*, the lock lever cam state switch cam 8 is in the unlocking range so as to indicate to the ECU 20 to consider the outside door handle 22 as unlocked. As a result, if the outside door handle 22 were pulled by a person outside the vehicle even if the person does not possess the electronic key fob or a key, the power release actuator 18 (FIG. 1) actuates the pawl release lever 17 so as to open the vehicle door.

The lock 27 shown in FIGS. 2*a*-2*d* includes a double pull override feature that permits the inside door release lever 1 to open the vehicle door even if the lock 27 is in the locked position. Referring to FIG. 2*a*, when the lock 27 in the locked position the lock lever cam 6 is in the locking range and thus holds the lock lever 3 in the locked position against the urging of the lock lever biasing member 9. Furthermore, the lock lever cam state switch cam 8 is in the locking range and as a result, the lock lever earn state switch 7 indicates to the ECU 20 that the lock 27 is locked so that the ECU 20 operatively disconnects the outside door handle 22 from the pawl release lever 17. Furthermore, the override member 10 is in the actuatable range.

When the inside door release lever 1 is actuated (i.e. moved to the actuated position) while the lock 27 is in the locked position (see FIG. 2*b*), the inside door release lever 1 does not move the auxiliary release lever 4 to the pawl release position. The movement of the inside door release lever 1 does, however, drive the override member 10 to move from a first position which is an actuatable position, to a second position which is in the non-actuatable range. Because the lock lever cam 6, the lock lever cam state switch cam 8 and the override member 10 are all connected together, the movement of the override member 10 to the second position (FIG. 2*b*) results in movement of the lock lever cam 6 to a position within the unlocking range and results in movement of the lock lever cam state switch cam 8 to a position within the unlocking range. The movement of the lock lever cam state switch cam 8 to within the unlocking range closes the lock lever cam state switch 7 so as to signal to the ECU 20 to permit operative control between the outside door handle 22 and the pawl release lever 17.

While the inside door release lever 1 is still actuated, a lock link keeper surface 58 optionally provided thereon holds the lock link 2 in the locked position. As a result, the lock lever 3 remains in the locked position even though the lock lever cam 6 no longer obstructs the movement of the lock lever 3 to the unlocked position. The respective states of the lock lever cam state switch 7 and the lock lever state switch 50 can be used to indicate to the ECU 20 that the lock 27 is in an 'override' state.

When the inside door release lever 1 is released from the actuated position and moves back to the home position (see FIG. 2*c*), the keeper surface 58 moves out of the way of the lock link 2, and so the lock link 2 and the lock lever 3 move to their unlocked positions under the urging of the lock lever biasing member 9 (FIG. 2*c*). As a result, the lock 27 is in the unlocked state. Thus, when the lock 27 was in the locked state, actuation and return to the home position of the inside door release lever 1 has moved the lock 27 to the unlocked state shown in FIG. 2*c*, wherein the inside door release lever 1 is operatively connected to the pawl release lever 17 through the lock link 2 and the auxiliary release lever 4. As a result, a second actuation of the inside door release lever 1 actuates the pawl release lever 17 so as to release the pawl 15 (FIG. 1) and open the vehicle door 900 (FIG. 11).

When the lock 27 is in the child-locked state, shown in FIG. 2*d*, the lock lever cam 6 is in the locking range, and as a result the lock link 2 and lock lever 3 are in their locked positions. Furthermore, the override member 10 is in a third position, which is in the non-actuatable range. As a result, the inside door release lever 1 is prevented from overriding the lock 27 and opening the vehicle door regardless of how many times the release lever 1 is actuated. Furthermore, the lock lever cam state switch cam 8 may be in the locking range, thereby resulting in the operative disconnection between the outside door handle 22 and the pawl release lever 17.

The lock 27 may be positionable in the unlocked, locked and child-locked positions by the lock actuator 19. More specifically, to move the lock 27 from the locked state (FIG. 2*a*) to the unlocked state (FIG. 2*c*) the lock actuation motor 11 may be actuated to rotate the driven gear 56 in a first direction (clockwise in the view shown in FIG. 2*a*) until the ECU 20 senses that the lock lever cam state switch cam 8 has moved to the unlocking range based on the state of the switch 7 and that the lock lever cam 6 has moved to the unlocking range based on the state of the switch 50. To move the lock 27 from the unlocked state (FIG. 2*c*) to the child-locked state (FIG. 2*d*) the lock actuation motor 11 may be actuated to rotate the driven gear 56 in the first direction (clockwise in the view shown in FIG. 2*c*) until the lock actuation motor 11 stalls as a result of engagement with a component connected to the driven gear 56 with a corresponding limit surface. To move the lock 27 from the locked state (FIG. 2*a*) to the child-locked state (FIG. 2*d*) the lock actuation motor 11 may be actuated to rotate the driven gear 56 in the first direction (clockwise in the view shown in FIG. 2*a*) until the lock actuation motor 11 stalls as a result of engagement with a component connected to the driven gear 56 with a corresponding limit surface.

To move the lock 27 from the child-locked state (FIG. 2*d*) to the unlocked state (FIG. 2*c*) the lock actuation motor 11 may be actuated to rotate the driven gear 56 in a second direction (counter-clockwise in the view shown in FIG. 2*d*) until the ECU 20 senses that the lock lever cam state switch cam 8 has moved to the unlocking range based on the state of the switch 7, and that the lock lever cam 6 has moved to the unlocking range based on the state of the switch 50. To move the lock 27 from the unlocked state (FIG. 2*c*) to the locked state (FIG. 2*a*) the lock actuation motor 11 may be actuated to rotate the driven gear 56 in the second direction (counter-clockwise in the view shown in FIG. 2*c*) until the lock actuation motor 11 stalls as a result of engagement with a component connected to the driven gear 56 with a corresponding limit surface. To move the lock 27 from the child-locked state (FIG. 2*d*) to the locked state (FIG. 2*a*) the lock actuation motor 11 may be actuated to rotate the driven gear 56 in the second direction (counter-clockwise in the view shown in FIG. 2*d*) until the lock actuation motor 11 stalls as a result of engagement with a component connected to the driven gear 56 with a corresponding limit surface.

During the aforementioned movements of the lock components, the lock state can be indicated to the ECU 20 by state of the lock lever cam state switch 7 and additionally in some cases by the most recent command issued by the ECU 20 to the lock actuation motor 11. More specifically, if the switch 7 indicates a locked state, and the most recent command by the ECU 20 was to rotate the motor 11 in the first direction, then the lock 27 is in the child-locked state. If the switch 7 indicates a locked state and the most recent command by the ECU 20 was to rotate the motor 11 in the second direction, then the lock 27 is in the locked state. If the switch 7 is indicates an unlocked state, then the lock 27 is in the unlocked state regardless of the most recent command issued by the ECU 20 to the motor 11. It will be noted that the lock state of the lock 27 could alternatively be determined by the state of the lock lever state switch 50 instead of the state of the switch 7.

Figure 2B:
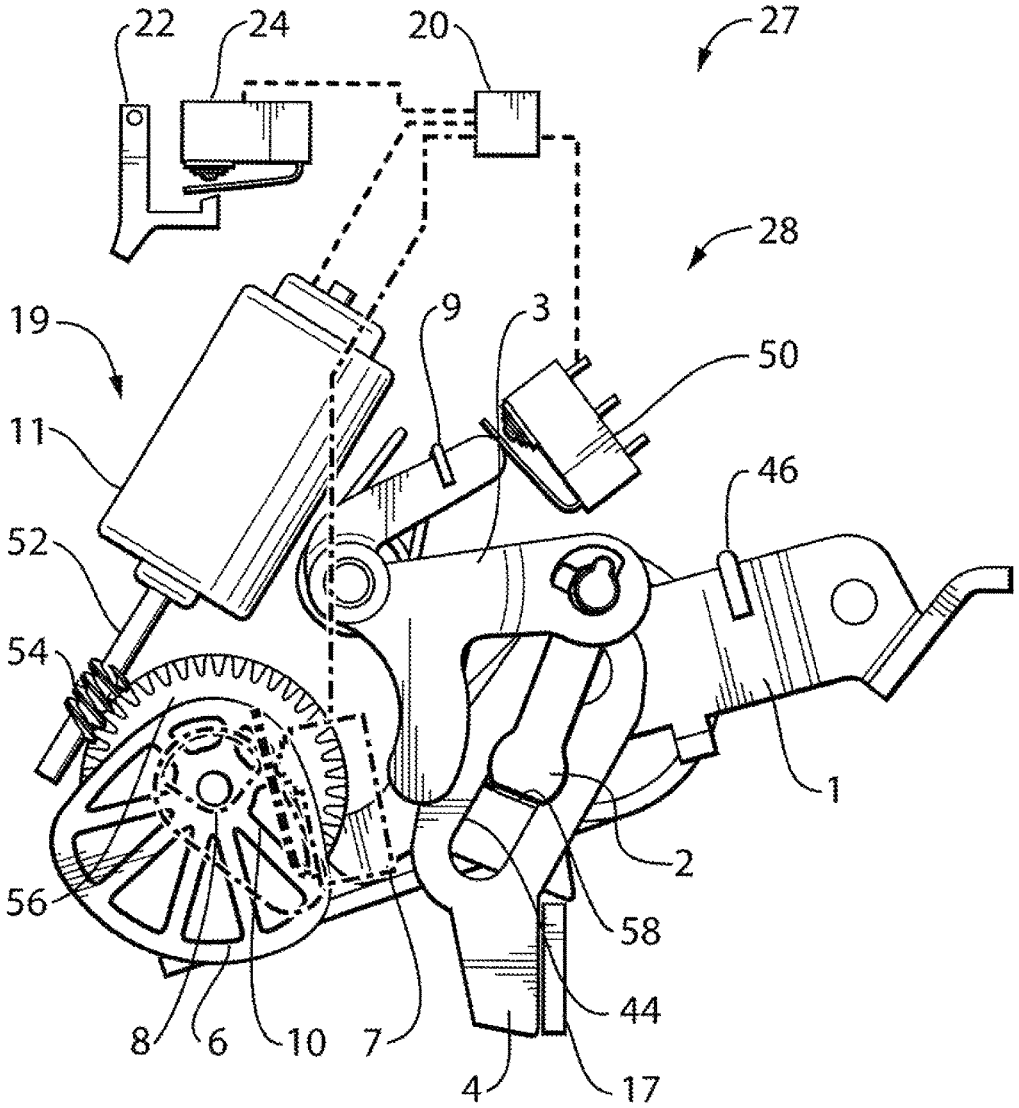
FIG. 2*b* is a plan view of the lock shown in FIG. 2*a*, in an override state.
Figure 2C:
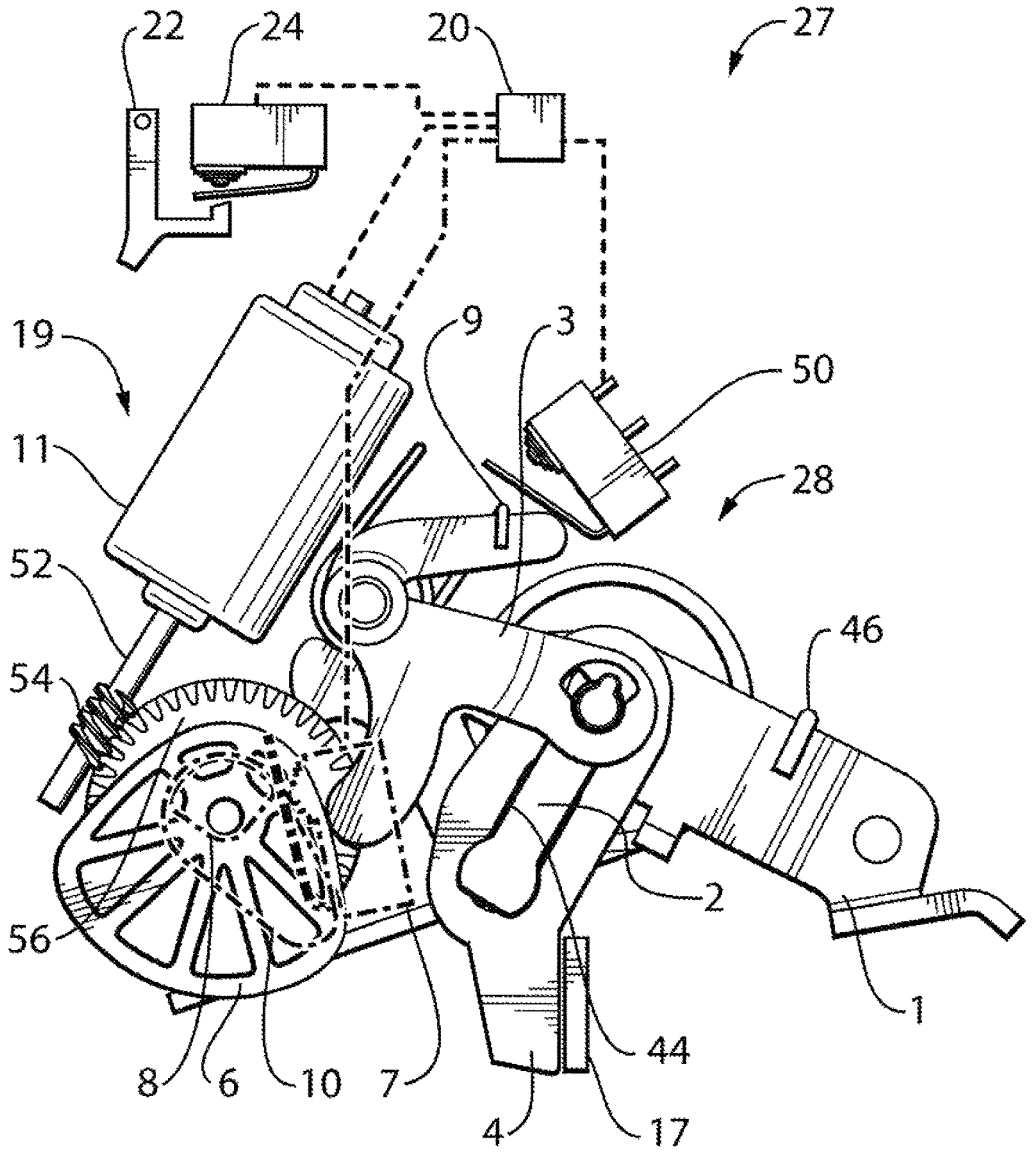
FIG. 2*c* is a plan view of the lock shown in FIG. 2*a*, in an unlocked state.
Figure 2D:
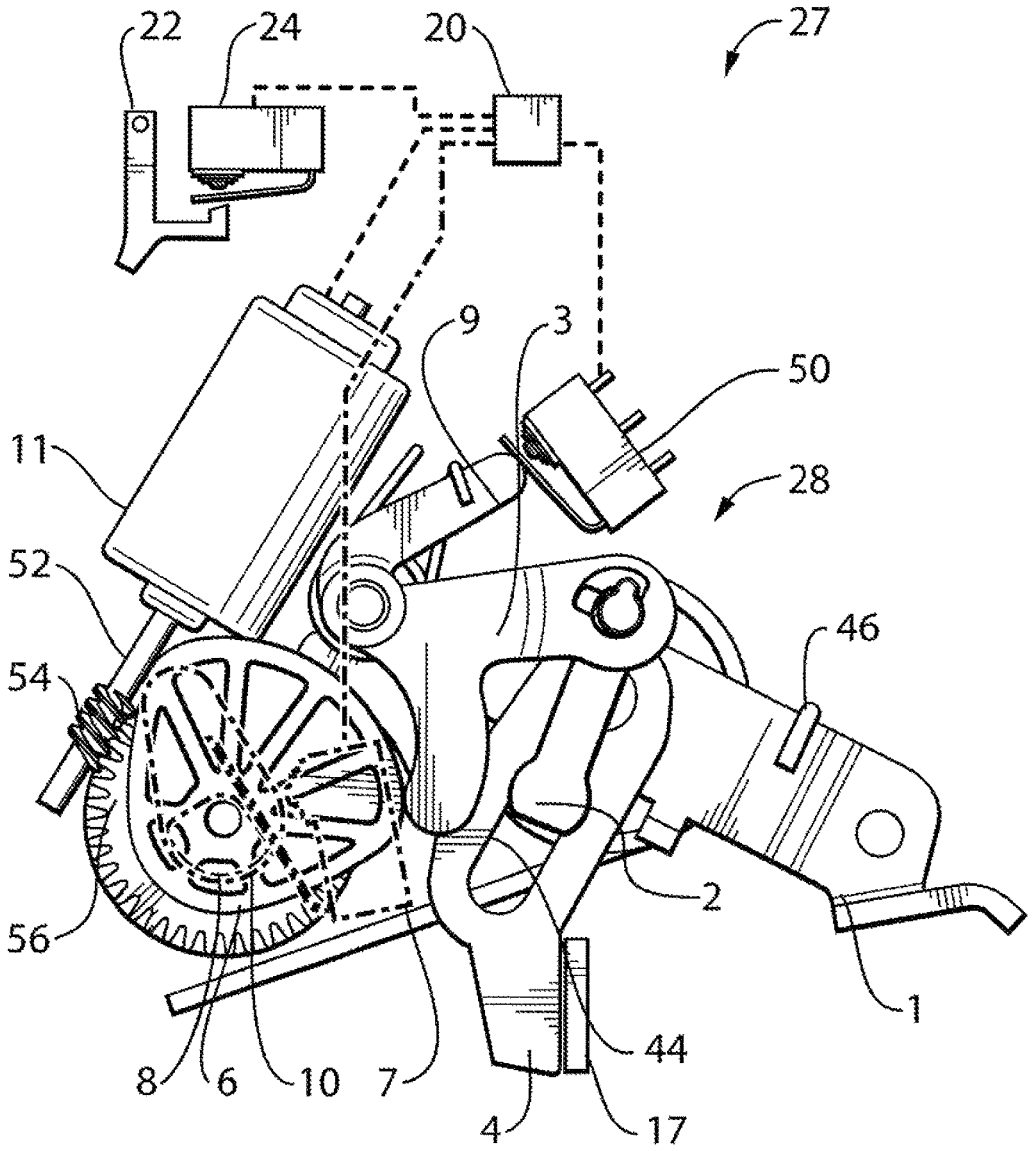
FIG. 2*d* is a plan view of the lock shown in FIG. 2*a*, in a child-locked state.

The lock 27 shown in FIGS. 2*a*-2*d* includes a 'panic' feature, which permits the lock state to be changed from the child-locked state (FIG. 2*d*) to the unlocked state (FIG. 2*c*), while the inside door release lever 1 is in the actuated position (FIG. 2*b*). Because the keeper surface 58 on the inside door release lever 1 keeps the lock lever 3 in the locked position, the lock lever 3 does not obstruct the movement of the lock lever cam 6 counter-clockwise to the unlocking range. As a result, when the inside door release lever 1 is released and moves back to the home position, the lock lever 3 can move to the unlocked position, and the lock 27 at that point will be in the unlocked state. Thus, the lock 27 permits the closure latch 13 to receive and act upon an instruction to unlock, even when a vehicle occupant has actuated the inside door release lever 1 and hold the release lever 1 in the actuated position.

In the child-locked state, the lock 27 does not permit the inside door release lever 1 to be able to open the closure latch 13, but the lock 27 may permit the inside door release lever 1 to unlock the outside door handle 22, so that the outside door handle 22 can subsequently be used to open the closure latch 13. To achieve this, an inside door release lever state switch shown at 70 may be provided for indicating to the ECU 20 the state of the inside door release lever (i.e. for indicating to the ECU 20 whether the inside door release lever 1 is in the home position or the actuated position). When the inside door release lever 1 is actuated, the ECU 20 can sense the actuation and if the lock 27 is in the child-locked state, the ECU 20 can unlock the outside door handle 22. When the inside door release lever 1 is actuated while the lock 27 is in the double-locked state, the ECU 20 would not unlock the lock link 2 or the outside door handle 22.

Instead of the motor 11 being capable of turning the driven gear 56 to a selected position associated with the child-locked state of the lock 27, it is alternatively possible for movement of the lock 27 into and out of the child-locked state to be manually controlled, (e.g. via a child lock mechanism that includes a lever that protrudes from an edge face of the vehicle door 900 (FIG. 11). In such an embodiment, the child lock mechanism may include a separate child lock cam that engages a suitable part of the lock lever 3 to control whether the lock lever 3 is movable to the unlocked position. The child lock cam may be rotatable between a locking range of positions and a non-locking range of positions.

Because the child locking capability is provided from the child lock mechanism, the ECU 20 can operate the motor 11 between two positions instead of three positions. The two positions would correspond to an unlocked state of the outside door hand lock 27 and, for example, a locked state.

Figure 4:
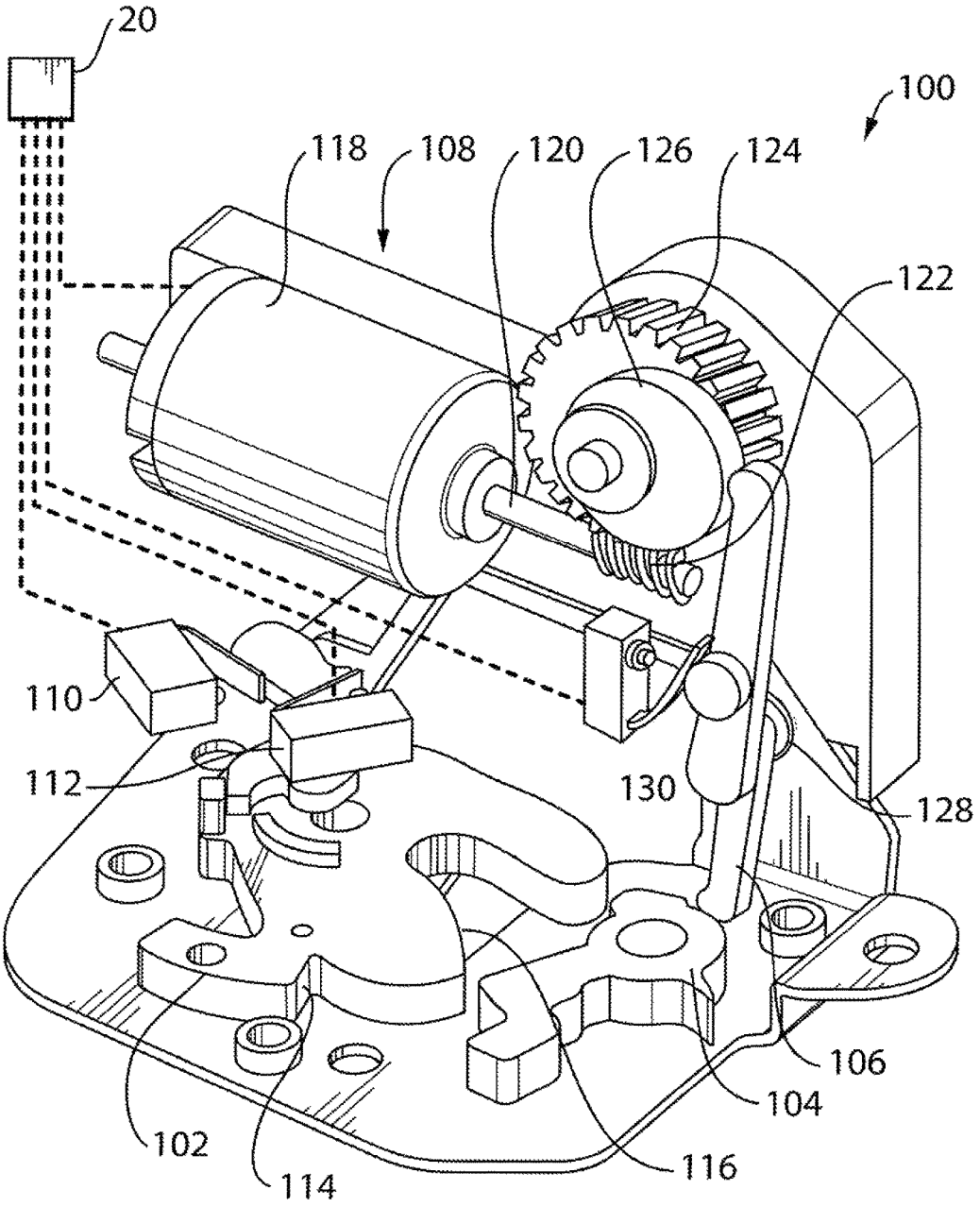
FIG. 4 is a perspective view of another embodiment of a closure latch.

Reference is made to FIG. 4, which shows another embodiment of a closure latch 100. The closure latch 100 includes a ratchet 102, a pawl 104 (which may be similar to the ratchet 14 and pawl 15 in FIG. 1 and which may be biased to the open position for the ratchet and to the ratchet locking position for the pawl by suitable biasing members), a pawl release lever 106 and a power release actuator 108. The ratchet 102 may have structure thereon for tripping two switches, shown at 110 and 112. The first switch 110 may be a door-ajar indicator switch, which is positioned to indicate a condition where the ratchet 102 is in the secondary position (i.e. where the pawl 104 holds the secondary locking surface, shown at 114 of the ratchet 102 instead of holding the primary locking surface 116). The second switch 112 may be used to indicate that the ratchet 102 is open (thereby indicating that the vehicle door is open).

The power release actuator 108 may include a power release actuator motor 118 with an output shaft 120 with a worm gear 122 thereon, which drives a driven gear 124. The driven gear 124 has a release lever actuation cam 126 connected thereto which pivots the pawl release lever 106 from a home position to a pawl release position (FIG. 4). A release lever biasing member 128 may be provided to bias the pawl release lever 106 towards its home position.

When the power release actuator 108 is used to release the pawl 104 to open the vehicle door, the ECU 20 may run the motor 118 until the ECU 20 receives a signal that the vehicle door is open (from switch 112), or until a selected time period has elapsed, indicating that the vehicle door is stuck (e.g. from snow or ice buildup on the vehicle). Upon receiving a signal from the door state switch that the vehicle door is open, the ECU 20 can send a signal to the motor 118 to reset the ratchet 102 and pawl 104 so that the pawl 104 is ready to lock the ratchet 102 when the vehicle door is closed.

The ECU 20 may receive signals from an inside door handle state switch (not shown in FIG. 4) and from the outside door handle state switch 24 which indicate to the ECU 20 whether either of the inside door handle (shown at 908 in FIG. 11) and the outside door handle 22 is in the home position or is actuated. The ECU 20 can provide any of several lock states including child-locked, unlocked, double-locked and locked, by selectively acting upon or ignoring actuation signals from the inside door handle and/or the outside door handle 22. These lock states may be logical states of the ECU 20. Functions such as double-pull override can be provided, whereby the ECU 20 unlocks the inside door handle upon a first actuation of the inside door handle (while the latch is locked).

A pawl release lever state switch 130 may be provided that senses the position of the pawl release lever 106. The state switch 130 can be used to indicate to the ECU 20 when the pawl release lever 106 has reached the actuated position.

The closure latch 13 described above has been described in the context of being used in a rear door of a vehicle. The closure latch 13 may also be used as shown in FIGS. 1 and 2*a*-2*d* in a front door of a vehicle having three lock states, including a locked state, an unlocked state and a double-locked state (instead of the child-locked state used in a rear door application). These three lock states may be provided by the similar structure that provided the three lock states (locked, unlocked and child-locked) for the closure latch 13 shown in FIGS. 1 and 2*a*-2*d*. One difference is that, when the lock 27 is in the double-locked state, the ECU 20 would not unlock the outside door handle 22 when the inside door release lever 1 is actuated, whereas the ECU 20 may be programmed to unlock the outside door handle 22 as described above when in the child-locked state in a rear door application.

With reference to 2*a*, it is optionally possible to provide an additional double lock feature for the closure latch 13. Thus, the lock 27 (and therefore the closure latch 13) would have a child-locked state, an unlocked state and a locked state and a double-locked state.

Figure 3:
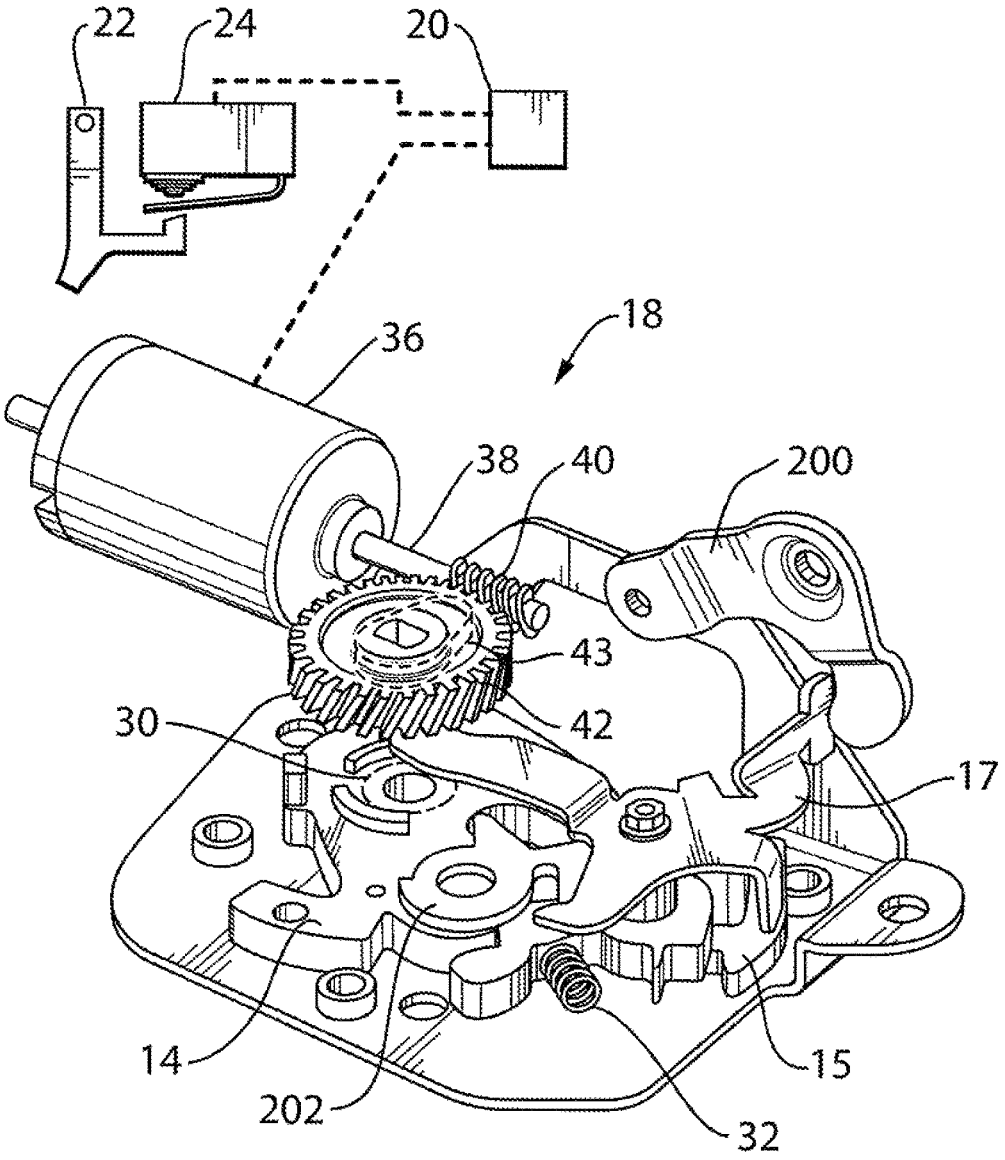
FIG. 3 is a perspective view of another embodiment of a closure latch.

Another example of a configuration for the closure latch 13 for a front door application is shown in FIG. 3. The closure latch 13 in FIG. 3 may include a lock (not shown) that has a locked state and an unlocked state, and that does not have a child-locked state. In the locked state, the lock disables the outside door handle 22. In the unlocked state, the lock permits actuation of the pawl release lever 17 by the outside door handle 22 through the power release actuator 18. The closure latch 13 in FIG. 3 may lack a double-pull override feature, permitting instead the direct actuation of the pawl release lever 17 by the inside door release lever, shown at 200, without regard as to whether or not the lock (not shown) is in the locked state. Optionally, the vehicle door 900 (FIG. 11) may include a key lock, which includes a key cylinder that is rotated using a key. In such an instance, an outside door release lever 202 may be provided, which is mechanically operatively connected to the pawl release lever 17 and which is itself mechanically actuated by rotation of the key cylinder.

The closure latch 13 can be configured to provide two lock states instead of three. For example, in a front door application, the closure latch may have a double-locked state and an unlocked state. In such a configuration, the override member 10 is not needed and may be omitted, because in the double-locked state, the inside door release lever 1 cannot be used to override the lock. Furthermore, the closure latch 13 may be configured so that the unlocked state represents a limit of travel for the driven gear 56 instead of corresponding to an intermediate position between two travel limits. As a result, the motor 11 can be rotated in a first direction until the motor 11 stalls to move the lock to the double-locked state, and can be rotated in a second direction until the motor 11 stalls to move the lock to the unlocked state.

In yet another variation, the closure latch 13 may be used in a front door application with two lock states: locked and unlocked, wherein the double pull override feature is provided as a way of moving the latch 13 out of the locked state. In this variation, the override member 10 is provided and can is engageable by the inside door release lever 1 to bring the latch 13 to the unlocked state, so that a subsequent actuation of the inside door release lever 1 will open the latch 13. The unlocked state can, in this variation, be at one limit of travel for the driven gear 56, while the locked state can be at the other limit of travel for the driven gear 56, so that when the motor 11 is used to change the lock state, the driven gear 56 is moved in one direction or the other until the motor 11 stalls.

Figure 5A:
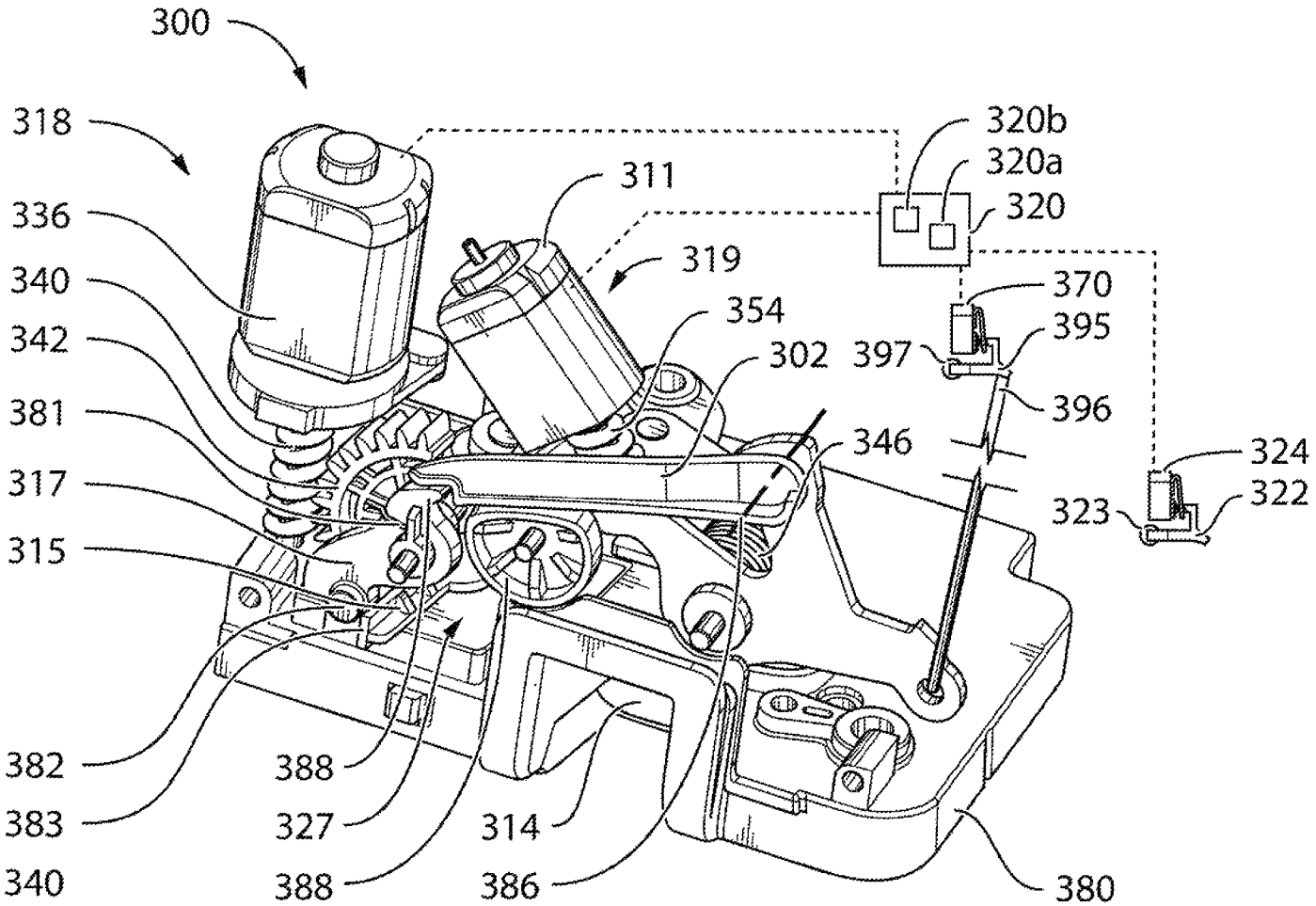
FIGS. 5*a* and 5*b* are perspective views of another embodiment of a closure latch.
Figure 5B:
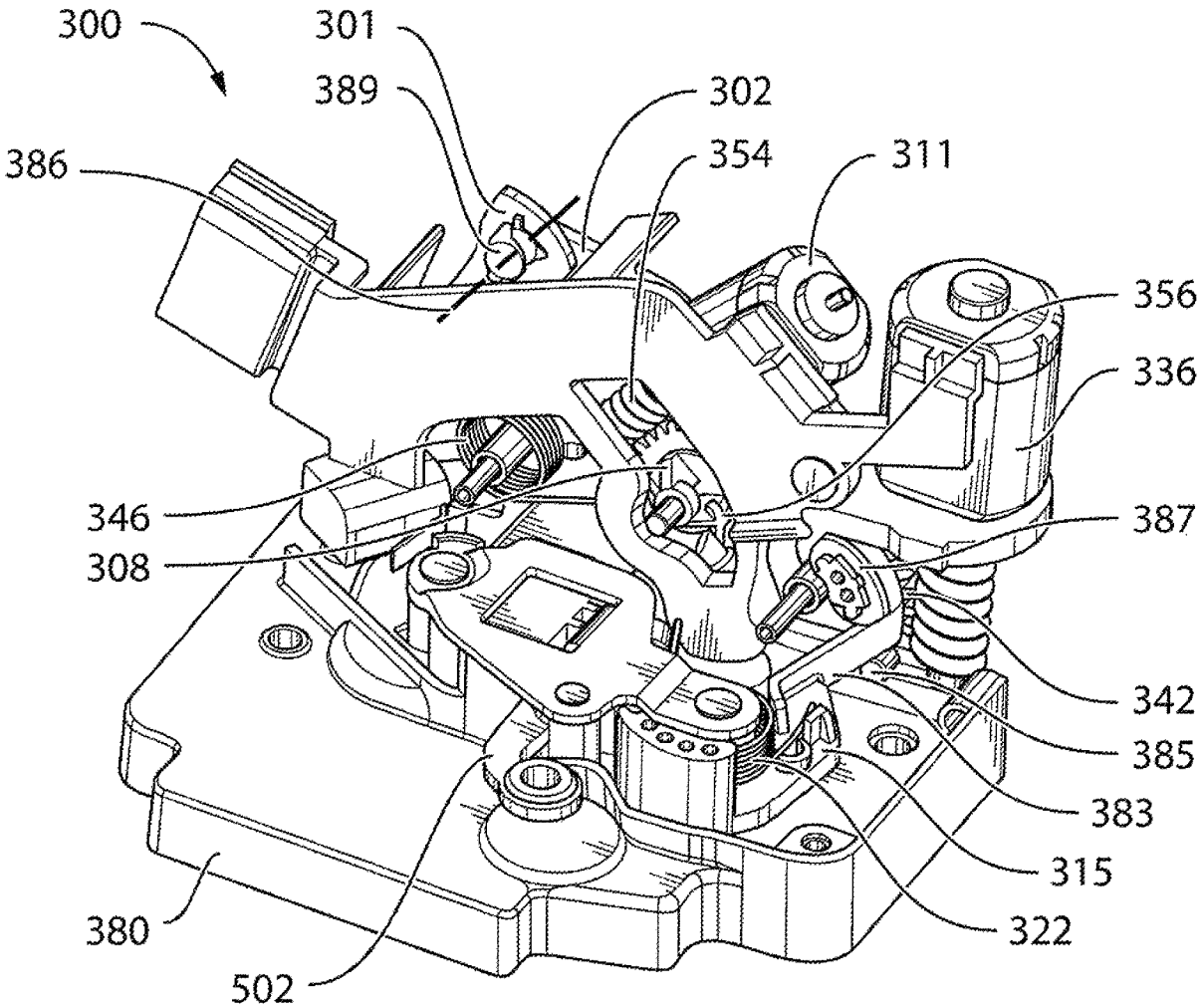

Reference is made to FIGS. 5*a* and 5*b*, which show another embodiment of a closure latch 300. In this embodiment, elements that are similar to elements shown in FIGS. 1-4 are provided with similar reference numbers. Thus, element 301 is similar to element 1 in FIGS. 1-4; element 302 is similar to element 2 in FIGS. 1-4; element 311 is similar to element 11 in FIGS. 1-4, and so on. The closure latch 300 may be similar to the closure latch 13, but may incorporate a fewer components which may provide reduced complexity and cost and increased reliability. The latch 300 includes a ratchet and pawl 314 and 315 which may be similar to the ratchet 14 and pawl 15 (FIG. 1), and which may be biased by a ratchet biasing member and a pawl biasing member respectively, which may be similar to the ratchet and pawl biasing members in FIGS. 1-4). The ratchet biasing member is obscured from view in FIGS. 5*a* and 5*b*, however, the pawl biasing member is shown at 322 in FIG. 5*b*.

A pawl release lever is shown at 317 and may be similar to pawl release lever 17 (FIG. 1). The pawl release lever 317 is pivotable between a home position and a pawl release position (FIG. 9) by any one of several elements, including an inside door release lever 301 via a lock link 302, a power release actuator 318 and an outside door release lever 502 (FIG. 5*b*). Pivoting of the pawl release lever 317 from a rest position (FIG. 6) to a pawl release position (FIG. 9) causes pawl release arm 382 on lever 317 to engage lever receiving arm 383 on the pawl 315 and to drive the pawl 315 to the ratchet release position. In the views shown in FIGS. 6-10 the pawl release lever 317 pivots counterclockwise to reach the pawl release position. The pawl release lever 317 may be biased towards the home position by a pawl release lever biasing member 381.

In similar manner to the power release actuator 18 in FIG. 1, the power release actuator 318 (FIGS. 5*a* and 5*b*) includes a power release actuator motor 336 with an output shaft with a worm 340 thereon. The worm 340 rotates a worm gear 342 (which may be referred to as a driven gear) which has a pawl drive surface 385 (FIG. 5*b*) thereon that is engageable with the lever receiving arm 383 on the pawl 315. The worm gear 342 is rotatable by the motor 336 (via the worm 340) between a home position (FIG. 6) and a pawl release position in which the worm gear 342 drives the pawl 315 to the ratchet release position. An ECU 320 controls the operation of the motor 336. The worm gear 342 may be biased towards the rest position by a worm gear biasing member 387 (FIG. 5*b*). It will be noted that during this movement, the worm gear 342 backdrives the worm 340. To permit this, the worm 340 has a thread angle that makes the worm 340 backdrivable.

Figure 6:
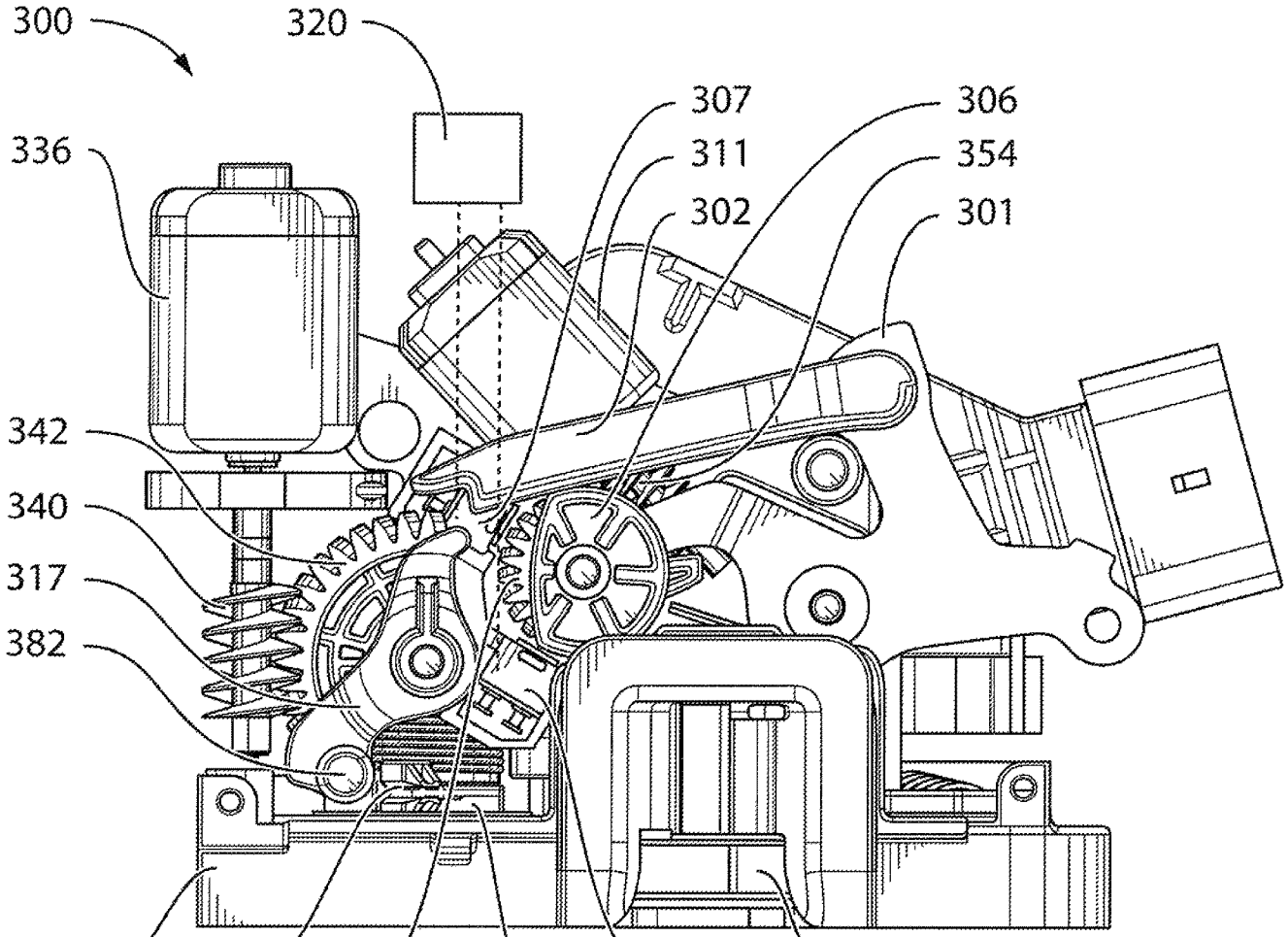
FIG. 6 is an elevation view showing the closure latch shown in FIG. 5*a* in a locked state.
Figure 7:
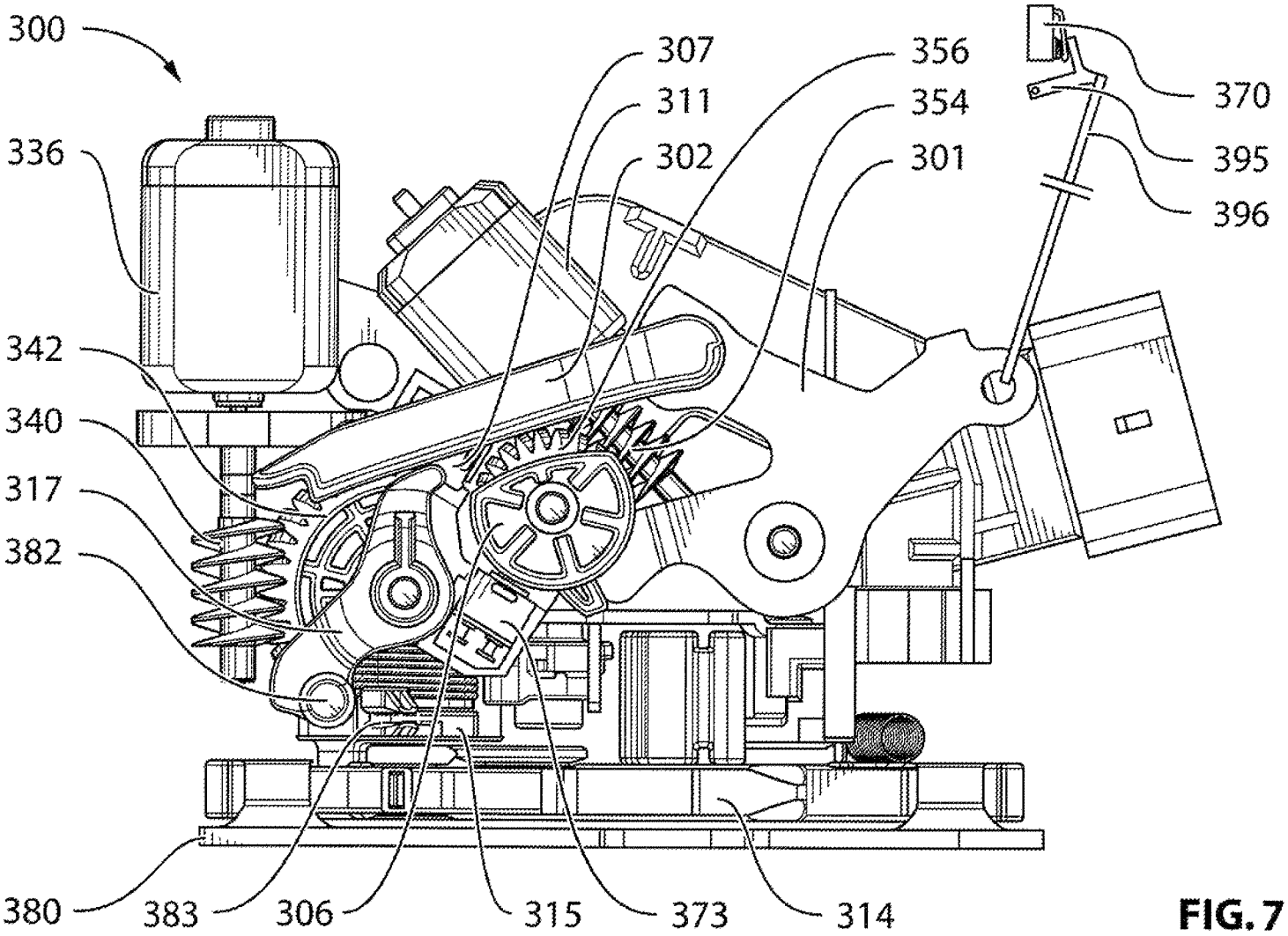
FIG. 7 is an elevation view showing the latch shown in FIG. 5*a* in a locked state, wherein an inside door handle has been actuated.

The inside door release lever 301 is movable (e.g. by a counterclockwise pivoting movement in the view shown in FIG. 6) from a home position (FIG. 6) to an actuated position (FIG. 7), and is biased towards the home position by an inside door release lever biasing member 346. The inside door release lever 301 is actuated by an inside door handle 395 (e.g. via a cable 396) as shown in FIGS. 6 and 7. The inside door handle 395 is movable (e.g. pivotable) between a home position (FIG. 6) and an actuated position (FIG. 9) wherein the door handle 395 brings the inside door release lever 301 to the actuated position. The door handle 395 may be biased towards the home position by an inside door handle biasing member 397 (e.g. a torsion spring).

The inside door handle 395 has an inside door handle state switch 370 associated therewith. The state switch 370 may have a first state, (e.g. off) when the inside door handle, and therefore the inside door release lever 301, is in the home position. The state switch 370 may have a second state, (e.g. on) when the inside door handle 395, and therefore the inside door release lever 395, is in the actuated position. Thus the state of the state switch 370 is indicative of the position of both the inside door handle 395 and of the inside door release lever 301. As such, the inside door handle state switch 370 may also be referred to as an inside door release lever state switch 370. In an alternative embodiment, the state switch 370 may be positioned so as to be engaged by the door release lever 301 instead of being engaged by the inside door handle 395.

An outside door handle 322 is provided and is movable (e.g. by a counterclockwise pivoting movement) from a home position (FIG. 6) to an actuated position, and is biased towards the home position by an outside door handle biasing member 323 (e.g. a torsion spring). The outside door handle 322 has an outside door handle state switch 324 associated therewith. The state switch 324 may have a first state, (e.g. off), when the outside door handle 322 is in the home position, and a second state, (e.g. on), when the outside door handle 322 is in the actuated position. Thus the state of the state switch 324 is indicative of the position of the outside door handle 322.

The ECU 320 (FIG. 5*a*) includes a processor 320*a* and a memory 320*b* that stores data used by the processor 320*a* during operation of the latch 300. The ECU 320 may be programmed in any suitable way to carry out operation of the latch 300 as described herein. The ECU 320 receives signals from the outside door handle state switch 324 and from the inside door handle state switch 370 and uses these signals to control the operation of the power release actuator motor 336, depending on what mode the ECU 320 is in. The ECU 320 is operable to be in a locked state (which may be referred to as a 'single-locked' state, or a first locked state, an unlocked state, and a second locked state. In the unlocked state, the ECU 320 causes actuation of the power release actuator motor 336 upon receipt of an indication that either of the inside or outside door handles 395 or 322 has been actuated.

In the locked state, the ECU 320 ignores signals from both the inside and outside door handle state switches 370 and 324 and as a result actuation of the inside or outside door handles 395 or 322 does not result in opening of the vehicle door 900 (FIG. 11). In some embodiments, actuation of the inside door handle 395 a first time may signal the ECU 320 to change states from a locked state to an unlocked state. Alternatively, actuation of the inside door handle 395 a first time may signal the ECU 320 to change states from a locked state to an inside door handle unlocked state, wherein the ECU 320 continues to ignore signals from the outside door handle 322 but would actuate the power release actuator motor 336 upon a second actuation of the inside door handle 395. In yet another alternative, actuation of the inside door handle 395 may not cause the ECU 320 to leave the locked state and thus the ECU 320 when in the locked mode may continue to ignore signals indicative of actuation of both the inside and outside door handles 395 and 322.

The second locked state may correspond for example, to a double locked state in embodiments wherein the latch 300 is installed in a front door of a vehicle, or for example, to a child locked state in embodiments wherein the latch 300 is installed in a rear door of a vehicle.

If the ECU 320 is in a double locked state, the ECU 320 ignores signals from the state switches 370 and 324 that are indicative of the actuation of the inside and outside door handles 395 and 322 and may continue to do so until the ECU 320 changes to a different state. If the ECU 320 is in a child locked state, an initial actuation of the inside and outside door handles 395 and 322 does not result in the actuation of the power release actuator motor 336. However, ECU 320 may be programmed such that, upon receipt of an initial actuation of the inside door handle 395, the ECU 320 may change to an outside unlocked state whereby actuation of the inside door handle 395 would not result in actuation of the motor 336, but actuation of the outside door handle 322 would result in the actuation of the motor 336 thereby opening the latch 300 and the vehicle door.

Figure 8:
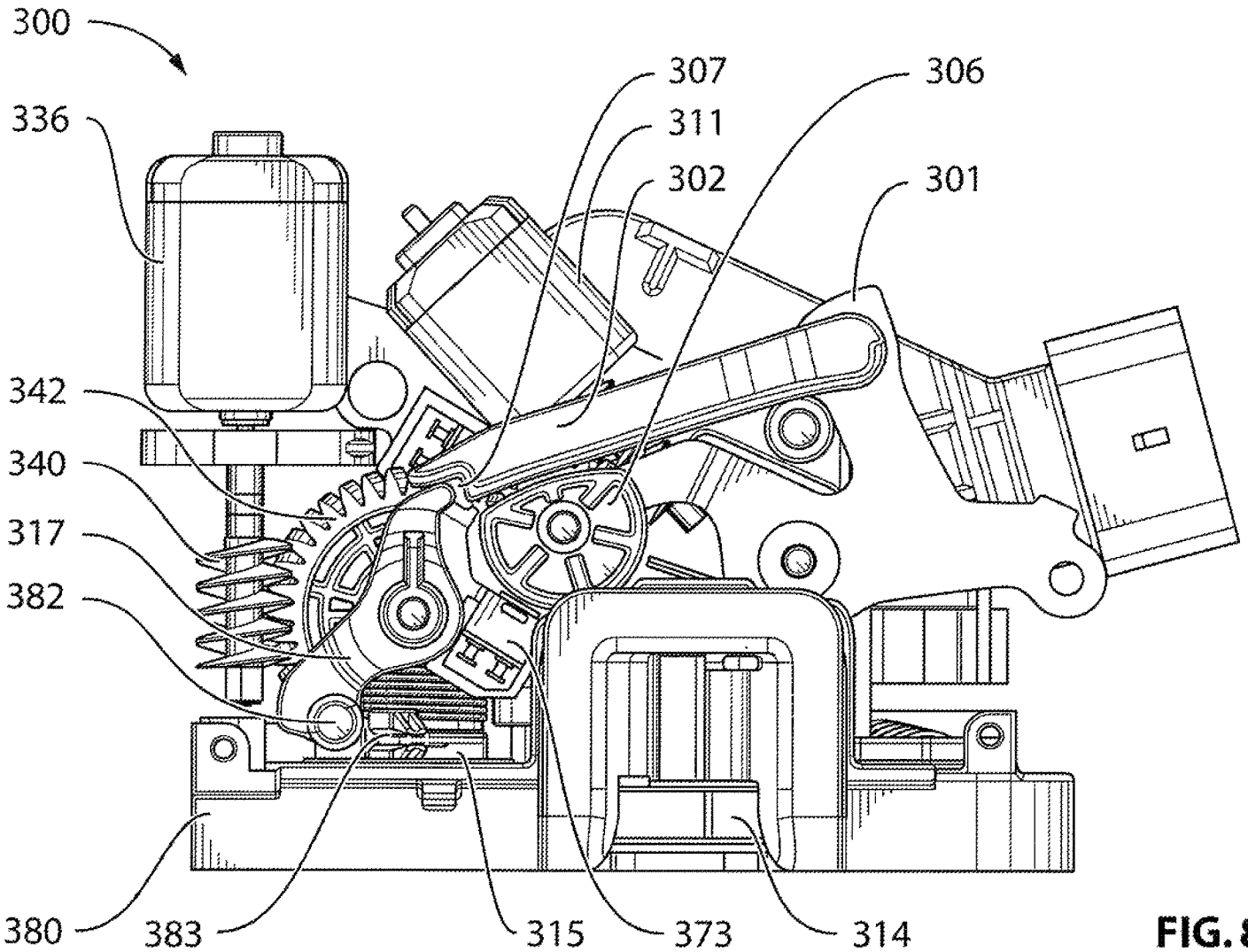
FIG. 8 is an elevation view showing the latch shown in FIG. 5*a* in an unlocked state.

A lock 327 is provided and is operable to prevent or permit mechanical actuation of the pawl release lever 317. The lock 327 includes, among other things, the lock link 302, a first cam 306 and a lock actuator 319. The lock link 302 is movable between an unlocked position as shown in FIG. 8 and a locked position shown in FIG. 6. In the unlocked position the lock link 302 operatively connects the inside door release lever 301 to the pawl 315 (via the common the release lever 317). In the locked position the lock link 302 operatively disconnects the inside door release lever 301 from the pawl 315. The movement of the lock link 302 may be a pivoting movement about a pivot axis 386 about which the lock link 302 may be pivotally connected to the inside door release lever 301. The lock link 302 is biased towards the unlocked position by a lock link biasing member which may be the tip (shown at 389 in FIG. 5*b*) of the inside door release lever biasing member 346, which may be any suitable type of biasing member such as a torsion spring.

Figure 9:
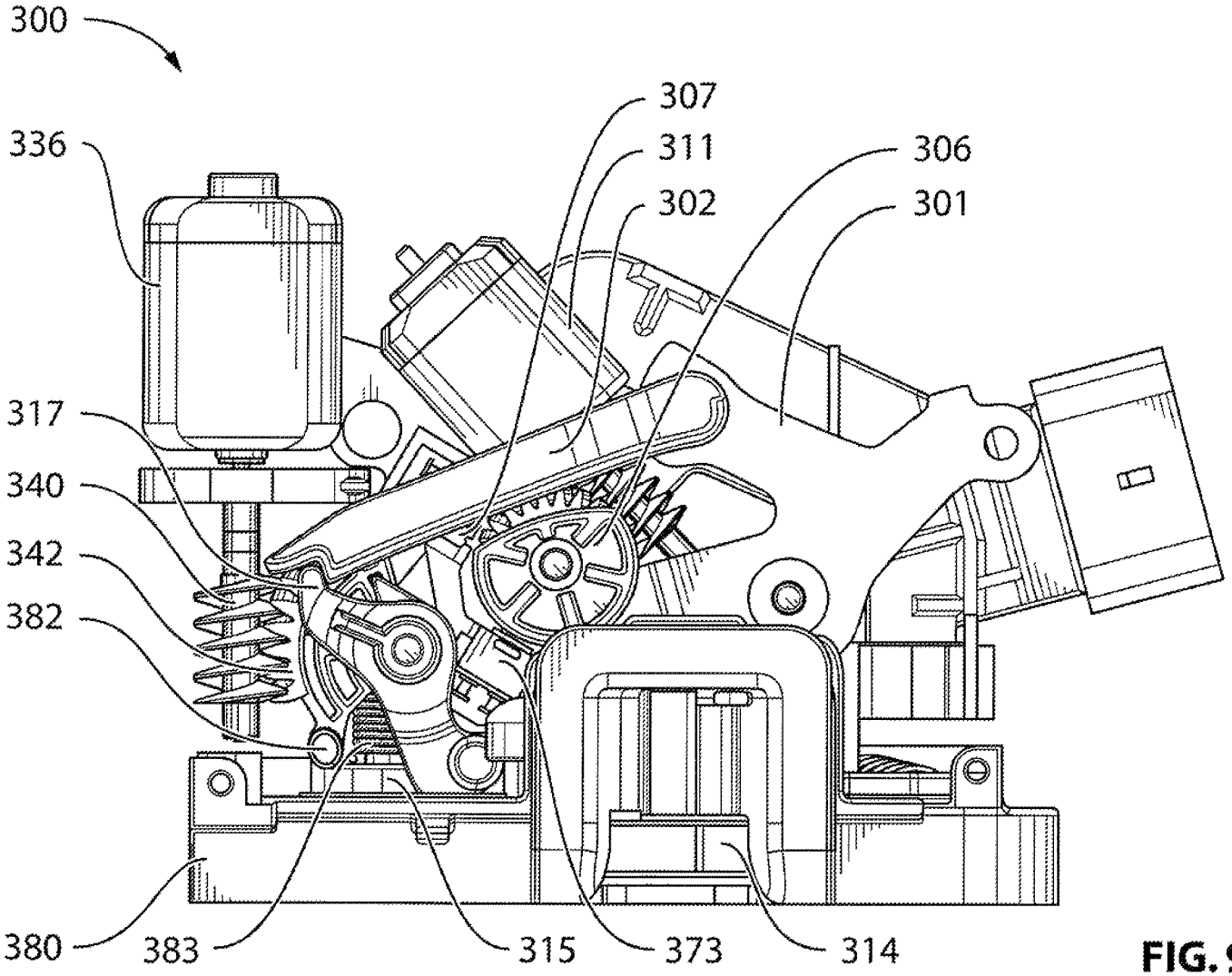
FIG. 9 is an elevation view showing the latch shown in FIG. 5*a* in an actuated state so as to permit opening of a vehicle door containing the latch.

The inside door release lever 301 pivots (counterclockwise in the views shown in FIGS. 6-10) from a home position (shown in FIG. 6) to an actuated position, thereby driving the lock link 302 to the left in the views shown in FIGS. 6-10. If the lock link 302 is in the unlocked position (FIG. 8), actuation of the release lever 301 drives the lock link 302 into a lock link receiving surface 388 on the pawl release lever 317 thereby driving the pawl release lever 317 to the pawl release position (FIG. 9). If the lock link 302 is in the locked position (FIG. 6), actuation of the release lever 301 drives the lock link 302 to the left in the view shown in FIGS. 6-10, but above the pawl release lever 317 (FIG. 7) such that the lock link 302 does not drive the common release 317 to the pawl release position.

Figure 10:
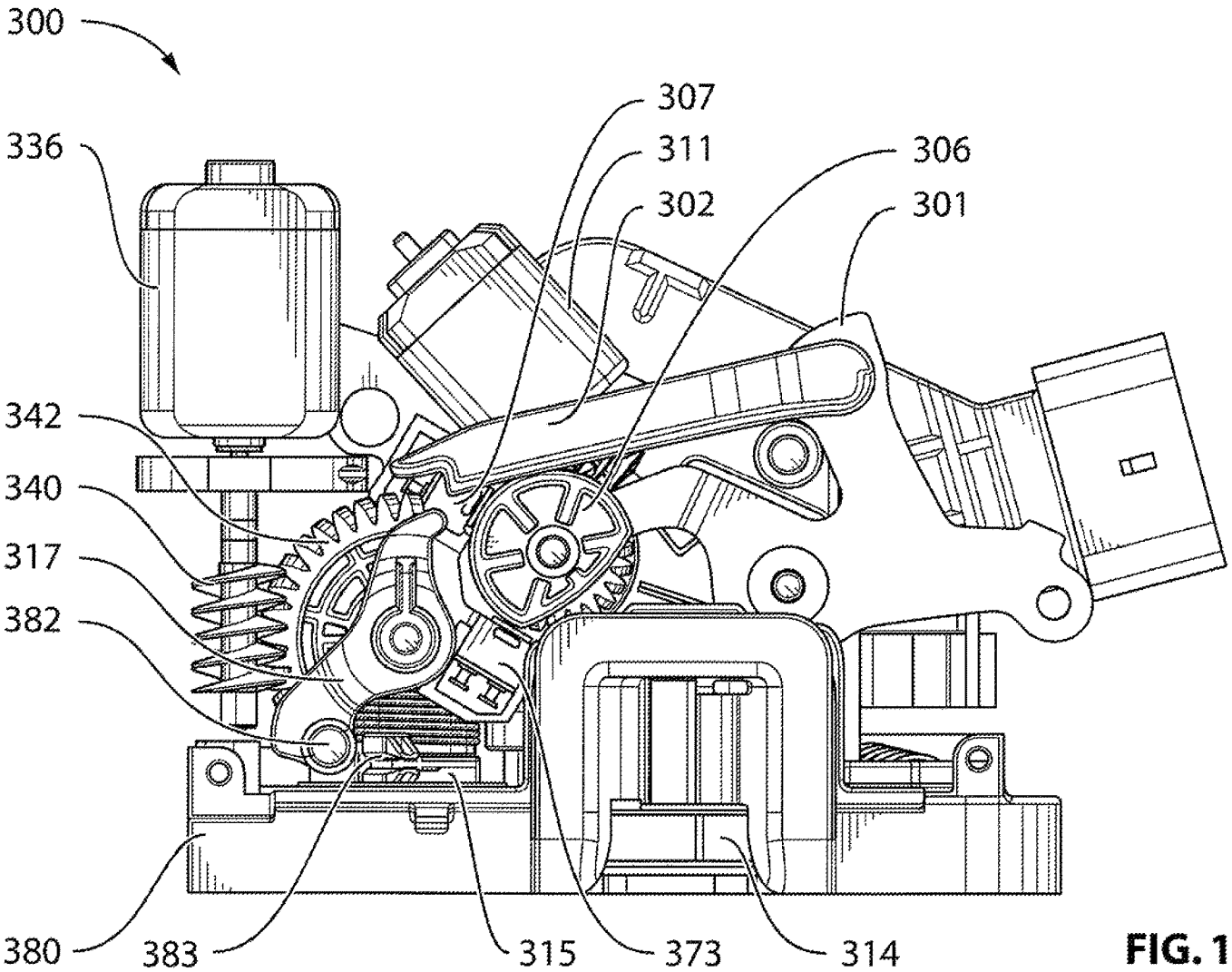
FIG. 10 is an elevation view showing the latch shown in FIG. 5*a* in a second locked state.

The first cam 306 is provided to control the position of the lock link 302 between the locked and unlocked positions, and may thus be referred to as a lock link control cam 306. The lock link control cam 306 is positionable in a locking position as shown in FIG. 6, an unlocking position as shown in FIG. 8 and a second locking position as shown in FIG. 10. In the unlocking position as shown in FIG. 8, the first cam 306 permits the lock link 302 to drive the pawl release lever 317 to the pawl release position as a result of actuation of the inside door release lever 306, thereby opening the latch 300 and the vehicle door 900 (FIG. 11). When the cam 306 is in the unlocking position the lock 327 is in an unlocked state.

When the first cam 306 is in the locking position the first cam 306 moves the lock link 302 to the locked position and thereby prevents the lock link 302 from driving the pawl release lever 317 to the pawl release position. However, when the first cam 306 is in the locking position, a cam drive surface 398 on the inside door release lever 301 is engageable with an override member 310 that is connected to the first cam 306 thereby operatively connecting the inside door release lever 301 with the first cam 306. The override member 310 may be said to be in an actuatable position. As a result, movement of the inside door release lever 301 to the actuated position (FIG. 7) drives the first cam 306 to the unlocking position. While the release lever 301 remains actuated, the lock link 302 extends above the pawl release lever 317 and is prevented by the pawl release lever 317 itself from moving to the unlocked position under the urging of the lock link biasing member 386. Once the inside door release lever 301 is returned to the home position (FIG. 8) the lock link 302 retracts sufficiently that the pawl release lever 317 no longer obstructs movement of the lock link 302, and thus the lock link biasing member 386 moves the lock link 302 to the unlocked position. Thus, as a result of a first or initial actuation of the inside door release lever 301 the lock 327 is in the unlocked state. As a result, a second actuation of the inside door release lever 301 opens the latch 300 and the vehicle door 900 (FIG. 11).

The second locking position, shown in FIG. 10, may, for example, be a double locking position or a child locking position. When the first cam 306 is in the second locking position, the override member 310 is in a non-actuatable position and so the cam drive surface 398 on the inside door release lever 301 cannot actuate the override member 310 and is thus operatively disconnected from the first cam 306. As a result, movement of the inside door release lever 301 to the actuated position produces no effect on the first cam 306.

Figure 5C:
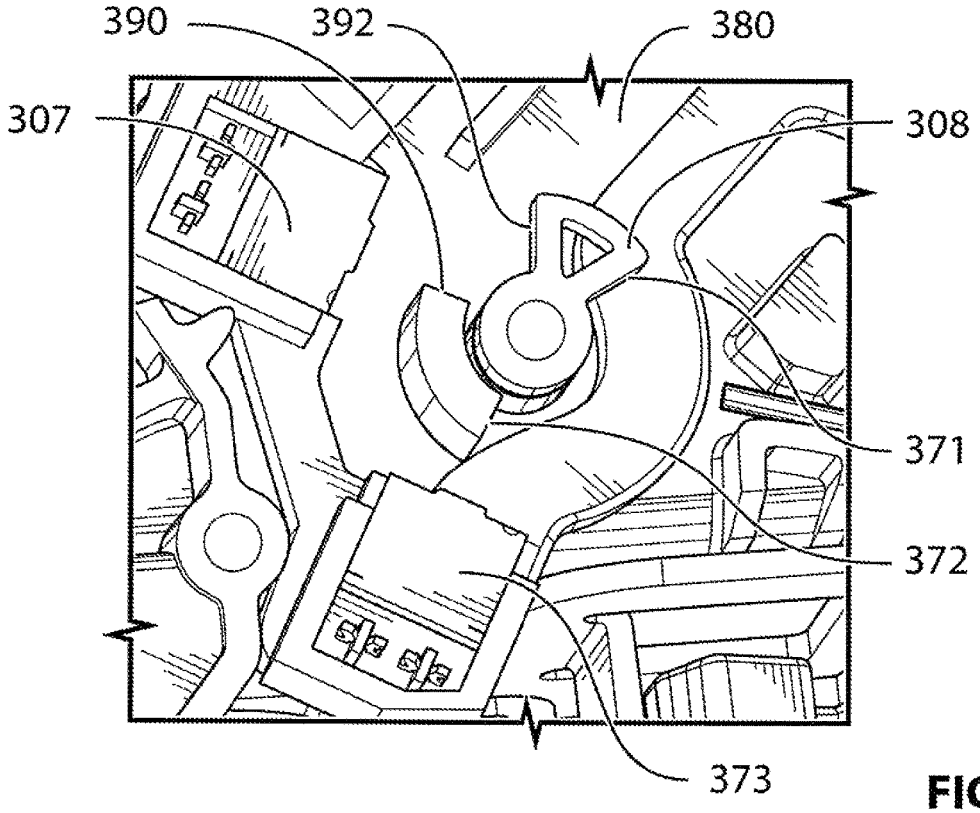
FIG. 5*c* is a perspective sectional view taken along section line 5*c*-5*c* in FIG. 5*b;*
Figure 5D:
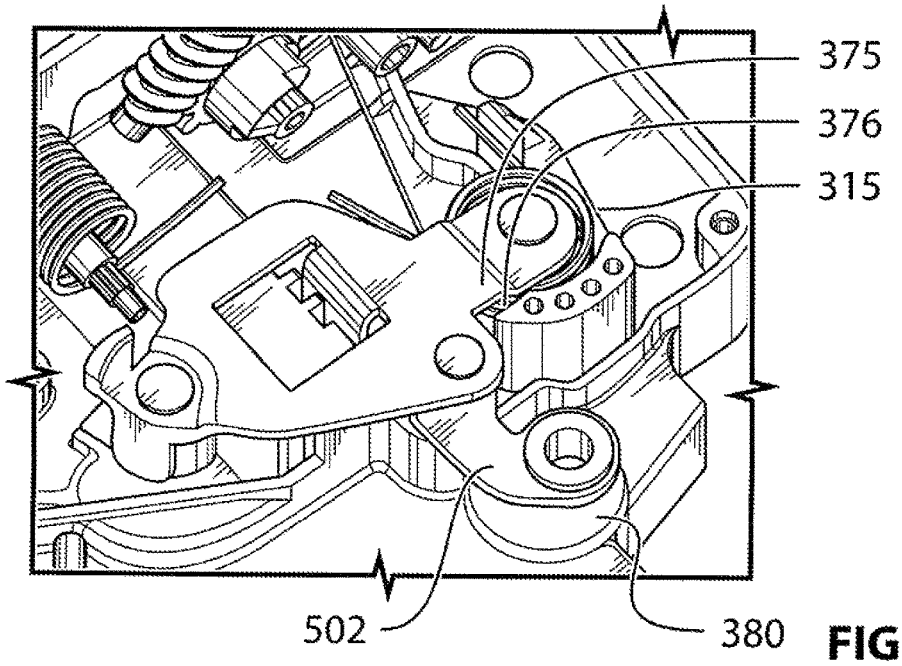
FIG. 5*d* is a magnified perspective view of a portion of the closure latch shown in FIG. 5*b;*

The lock actuator 319 includes a lock motor 311 that drives a worm 354, that, in turn, drives a worm gear 356 (which may be referred to as a driven gear). The worm gear 356, in turn, is connected to and thus drives the first cam 306. To reach the locking position, the lock motor 311 may drive the rotation of the first cam 306 in a first direction (counterclockwise in the view shown in FIG. 6) until the lock motor 311 stalls as a result of engagement of a first limit surface 390 (FIG. 5*b*) on the first cam 306 with a first limit surface 392 (FIG. 5*c*) on the housing (shown at 380) of the latch 300. FIG. 5*c* is a sectional view taken along section line 5*c*-5*c* in FIG. 5*b*. The portion of the housing shown in FIG. 5*c* is not shown in FIGS. 5*a* and 5*b*.

As noted above, movement of the inside door release lever 301 to the actuated position (FIG. 7) drives the first cam 306 to the unlocking position when the first cam 306 is in the locking position. It will be noted that during this movement, the worm gear 356 backdrives the worm 354. To permit this, the worm 354 has a thread angle that makes the worm 354 backdrivable.

When the first cam 306 is in the locking position shown in FIG. 6, a first switch 307 which may be a first locking position state switch 307 is closed by engagement with a state switch cam 308 that co-rotates with the first cam 306. The ECU 320 receives signals from the first locking position state switch 307 indicative of the state of the switch 307. The closing of the first locking position state switch 307 by the state switch cam 308 indicates to the ECU 320 that the latch 300 is in a locked state, and as a result, the ECU 320 enters the locked state as described above.

As can be seen in FIG. 8, when the first cam 306 is in the unlocking position the position of the state switch cam 308 is away from the state switch 307, and as a result, the switch 307 is of (i.e. open). Thus, the ECU 320 determines that the first cam 306 is in the unlocked position, and as noted above, can enter an inside unlocking state, an unlocked state or the ECU 320 can remain in the locked state.

To reach the second locking position, reversal of the current to the lock motor 311 may drive the first cam 306 in a second direction (clockwise in the view shown in FIG. 6) until the lock motor 311 stalls as a result of engagement of a second limit surface 371 (FIG. 5*b*) on the lock cam 308 and thus associated with the first cam 306, with a second limit surface 372 (FIG. 5*c*) on a portion of the housing 380 of the latch 300, as shown in FIG. 10. When the first cam 306 is in the second locking position shown in FIG. 10, the first locking position state switch 307 is open since the state switch cam 308 is unengaged with the switch 307. The latch 300 further includes a second switch 373, which may be a second locking position state switch, and which may be closed by engagement with the state switch cam 308 thereby indicating to the ECU 320 that the first cam 306 has reached the second locking position. As a result, the ECU 320 enters the second locked state as described above. Thus, during operation of the latch 300, the state switches 373 and 370 together have three states: a first state wherein the first state switch 370 is closed and the second state switch 373 is open, indicating that that the lock 327 is in the locked state, a second state wherein the first state switch 370 is open and the second state switch 373 is open, indicating that the lock 327 is in an unlocked state, and a third state wherein the first state switch 370 is open and the second state switch 373 is closed, indicating that the lock 327 is in a second locked state.

In each of the locked, unlocked, and second locked positions, the first cam 306 is held in each position by engagement between the worm 354 and the worm gear 356. There is no need for a biasing member to bias the first cam 306 towards any particular position.

It will be noted that, regardless of the state of the lock 327 the ECU 320 can be put into any of several unlocked states such that actuation of the inside and/or outside door handles 395 and 322 can be used to open the latch 300 and the vehicle door. Furthermore, actuation of the pawl release lever 317 by the power release actuator motor 336 takes place without requiring or generating any movement of the lock link 302 or other components of the lock 327. As a result, the latch 300 can include a passive entry feature such that detection by the ECU 320 of a key fob associated with the vehicle, can be used to unlock at least the outside door handle 322 of the latch 300 essentially instantaneously, since such unlocking amounts to a change of state of the ECU 320 from the locked state to the unlocked state (or to an outside door handle unlocked state). When the user actuates the outside door handle 322, the motor 336 is needed only to actuate the pawl release lever 317 and not any of the components of the lock 327 thereby reducing the work that needs carried out by the motor 336 to open the latch 300, which in turn reduces the amount of time that is needed to open the latch 300. This can result in less of a wait time by the user of the vehicle before the vehicle door opens after the outside door handle 322 has been actuated.

Referring to FIG. 5*b*, the outside door release lever 502 is a lever that can be used to mechanically actuate the pawl 315 from outside the vehicle in situations where such actuation is needed (e.g. in the event of a loss of power to the latch, or failure of the motor 336). The outside door release lever 502 may be pivoted (clockwise in FIGS. 6-10) by inserting a key into and turning the key cylinder (not shown), thereby driving the pawl 315 to the ratchet release position by engagement of a drive surface 375 on the release lever 502 with a receiving surface 376 on the pawl 315.

As can be seen the latch 300 operates without using a lock lever, which reduces the number of components in the latch 300 as compared to the latch 13 in FIGS. 1-4.

The outside door handles 22 and 322 have been shown in the figures as being pivotable members that engage limit switches shown at 24 and 324 respectively. It will be understood that the door handles 22 and 322 need not be movable at all, and the switches 24 and 324 could be configured to sense the presence of a user's hand on or near the door handle 22 or 322. For example, the switch could be a proximity sensor, or a suitable type of touch sensor (e.g. a resistive, capacitive or projected capacitive touch sensor).

The ECU 320 has been described as having a locked state, an unlocked state and a second locked state, which could be a child locked state or a double locked state. It will be noted that it is possible for the ECU 320 to be capable of having a child locked state and capable of having a double locked state. In other words the latch 300 may be configured to three different locked states that can be selected by the user, namely, a locked state wherein the inside and outside door handles 395 and 322 are disabled (but in which the first cam 306 is positioned to permit a mechanical override by the inside door handle 395), a child locked mode wherein the inside and outside door handles 395 and 322 are disabled (but in which a first actuation of the inside door handle 395 brings the ECU 320 to an outside door handle unlocked state wherein actuation of the outside door handle 322 causes the ECU 320 to actuate the power release actuator motor 336 to open the latch 300 and actuation of the inside door handle 395 does not cause actuation of the power release actuator motor 336), and a double locked state wherein the inside and outside door handles 395 and 322 are disabled and cannot be reenabled by actuation of either handle 395 or 322.

While two switches 307 and 373 are shown to assist the ECU 320 in determining whether the first cam 306 is in a locked state, an unlocked state, or a second locked state, it will be noted that it is possible to provide a structure wherein a single three position switch could be used to indicate to the ECU 320 which state the first cam 306 is in.

While the above description constitutes a plurality of embodiments, it will be appreciated that the present disclosure is susceptible to further modification and change without departing from the fair meaning of the accompanying claims.

The invention claimed is:

1. A closure latch for a vehicle door, the closure latch comprising:

a ratchet movable between an open position and a closed position and biased towards the open position;

a pawl movable between a ratchet locking position wherein the pawl holds the ratchet in the closed position and a ratchet release position wherein the pawl permits the ratchet to move to the open position, and wherein the pawl is biased towards the ratchet locking position;

an inside door release lever operatively connectable to the pawl; and a lock including:

a lock link that is pivotable between an unlocked position wherein the lock link operatively connects the inside door release lever to the pawl, and a locked position wherein the lock link operatively disconnects the inside door release lever from the pawl, wherein the lock link is biased towards the unlocked position;

a first cam rotatable between an unlocking position wherein the first cam directly pivots the lock link to the unlocked position, and a locking position wherein the first cam directly pivots the lock link to the locked position; and an override member connected for rotation with the first cam and rotatable between an actuatable position wherein the inside door release lever is engageable with the override member to move the first cam to the unlocking position, and a non-actuatable position wherein the inside door release lever is operatively disconnected from the override member, further comprising a first switch and a second switch each having a first state and a second state, wherein when the first cam is in the locking position, the first switch is in the first state and the second switch is in the second state, which indicates to an electronic control unit to enter a locked state wherein the electronic control unit operatively disconnects an outside door handle and an inside door handle from the pawl, wherein when the first cam is in a second locking position, the first switch is in the second state and the second switch is in the first state, which indicates to the electronic control unit to enter a second locked state wherein the electronic control unit operatively disconnects the outside door handle and the inside door handle from the pawl, and wherein when the first cam is in the second locking position, the first switch is in the second state and the second switch is in the second state, which indicates to the electronic control unit to enter an unlocked state wherein the electronic control unit operatively connects at least the outside door handle to the pawl, wherein the lock is positionable in an unlocked state wherein the lock link is in the unlocked position, a locked state wherein the lock link is in the locked position, the first cam is in the locking position and the override member is in the actuatable position, and a second locked state wherein the lock link is in the locked position, the first cam is in the locking position and the override member is in the non-actuatable position.

2. The closure latch as claimed in claim 1, wherein the outside door handle is operatively connectable to the pawl via a power release actuator motor that is controllable by the electronic control unit to drive movement of the pawl between the ratchet release position and the ratchet locking position;

and wherein the second locked state is a child-locked state, and the lock further includes an inside door handle state switch that is configured to indicate actuation of the inside door handle to the electronic control unit, wherein, when the electronic control unit is in the child-locked state, the electronic control unit is configured to enter an outside door handle unlocked state upon actuation of the inside door handle, wherein in the outside door handle unlocked state the electronic control unit actuates the power release actuator motor to move the pawl to the ratchet release position upon actuation of the outside door handle, and does not actuate the power release actuator motor to move the pawl to the ratchet release position upon actuation of the inside door handle.

3. The closure latch as claimed in claim 2, further comprising a power release actuator motor that is operatively connected to the pawl to move the pawl to the ratchet release position, wherein the electronic control unit is configured to operate the power release actuator motor based on detection of actuation of at least one of the inside and outside door handles and based on which state the electronic control unit is in.

4. The closure latch as claimed in claim 3, wherein the pawl is movable to the ratchet release position by the power release actuator motor independent of the position of the first cam.

5. The closure latch as claimed in claim 2, further comprising a lock actuation motor that is operatively connected to the first cam and that is controllable by the electronic control unit to drive the first cam in a first direction to the locking position and to drive the first cam in a second direction to the second locking position.

6. The closure latch as claimed in claim 5, wherein the lock actuation motor is rotatable between a first position associated with the locked state of the lock wherein the first cam and override member are driven by a driven gear to the locking position and the actuatable position respectively, a second position associated with the unlocked state of the lock wherein the first cam is driven by the driven gear to the unlocking position, and a third position associated with an additional locked state of the lock, wherein the first cam and the override member are driven by the driven gear to the locking position and the non-actuatable position respectively.

7. The closure latch as claimed in claim 2, further comprising an outside door release lever that is movable from a rest position to a paw release position by rotation of a key cylinder, wherein movement of the outside door release lever to the pawl release position moves the pawl to the ratchet release position.

8. The closure latch as claimed in claim 1, wherein the lock link is pivotably connected to the inside door release lever.

9. The closure latch as claimed in claim 1, wherein a first actuation of the inside door release lever is configured to result in movement of the inside door release lever to an actuatable position while the lock link extends above a pawl release lever to inhibit the pawl release lever from moving to the position of the unlocked state.

10. The closure latch as claimed in claim 1, wherein further actuation of the inside door release lever is configured to open the closure latch such that the inside door release lever is returned to a home position between an earlier actuation and the further actuation.

11. The closure latch as claimed in claim 1, wherein the lock link is driven by the inside door release lever.

* * * * *